US010781541B2

(12) United States Patent
Goijarts et al.

(10) Patent No.: US 10,781,541 B2
(45) Date of Patent: Sep. 22, 2020

(54) STRETCHABLE TEXTILE STAY AND TRANSFER SHEET

(71) Applicant: SENSE TEXTILE B.V., CJ Oisterwijk (NL)

(72) Inventors: Gregorius Goijarts, CJ Oisterwijk (NL); Stephanus Schilthuizen, MG Berkl-Enschot (NL)

(73) Assignee: SENSE TEXTILE B.V., CJ Oisterwijk (NL)

( * ) Notice: Subject to any disclaimer, the term of this patent is extended or adjusted under 35 U.S.C. 154(b) by 571 days.

(21) Appl. No.: 15/109,057

(22) PCT Filed: Dec. 30, 2014

(86) PCT No.: PCT/EP2014/079463

§ 371 (c)(1),
(2) Date: Jun. 29, 2016

(87) PCT Pub. No.: WO2015/101631

PCT Pub. Date: Jul. 9, 2015

(65) Prior Publication Data

US 2016/0326674 A1 Nov. 10, 2016

(30) Foreign Application Priority Data

Dec. 31, 2013 (NL) ..... 1040582

(51) Int. Cl.
*D04B 1/18* (2006.01)
*A61G 7/10* (2006.01)

(52) U.S. Cl.
CPC ..... *D04B 1/18* (2013.01); *A61G 7/1026* (2013.01); *D10B 2403/0112* (2013.01);
(Continued)

(58) Field of Classification Search
CPC . D04B 1/10; D04B 1/102; D04B 1/12; D04B 1/123; D04B 1/18; A61G 7/1026
See application file for complete search history.

(56) References Cited

U.S. PATENT DOCUMENTS 3,971,234 A 7/1976 Taylor
4,267,710 A * 5/1981 Imamichi ..... D04B 1/12 66/196

(Continued)

FOREIGN PATENT DOCUMENTS

CA 1224889 A 7/1987
CH 705247 A1 1/2013

(Continued)

OTHER PUBLICATIONS

International Search Report in International Application No. PCT/EP2014/079463, dated Mar. 23, 2015, 3 pages.

*Primary Examiner* — Danny Worrell
(74) *Attorney, Agent, or Firm* — Fitch, Even, Tabin & Flannery LLP

(57) ABSTRACT

A smart textile solution to facilitate permanent and long time staying in wheelchairs, chairs and on beds of chronically ill, less mobile and immobile patients especially in the elderly care, nursery care, rehabilitation and homecare in the embodiment of a textile based stretchable stay and transfer layer which can cover mattresses and cushions. Technical solutions within the invention are provided to guarantee a dry skin and to control the temperature thereof, the so called control of the micro climate, to lower and evenly distribute pressures and shear forces, and moreover to enable an easy low friction movement of patients in bed or in sitting positions, and to enable transfers into the bed and transfers out of the bed.

25 Claims, 21 Drawing Sheets

(52) U.S. Cl.
CPC .... *D10B 2403/02* (2013.01); *D10B 2403/021* (2013.01); *D10B 2503/06* (2013.01)

(56) References Cited

U.S. PATENT DOCUMENTS

| | | | | |
|---|---|---|---|---|
| 5,013,089 | A * | 5/1991 | Abu-Isa | A47C 7/282 297/224 |
| 5,422,153 | A * | 6/1995 | Miyamoto | D04B 21/02 428/116 |
| 5,735,145 | A | 4/1998 | Pernick | |
| 6,105,401 | A * | 8/2000 | Chadeyron | D04B 1/22 66/195 |
| 6,151,928 | A * | 11/2000 | Anyon | D04B 1/16 66/193 |
| 6,300,525 | B1 | 10/2001 | Anderson et al. | |
| 6,622,528 | B2 * | 9/2003 | Masse | D04B 9/28 66/196 |
| 6,755,052 | B1 | 6/2004 | Sytz | |
| 7,240,522 | B2 * | 7/2007 | Kondou | D04B 1/18 66/195 |
| 7,465,683 | B2 * | 12/2008 | McMurray | D04B 21/04 442/152 |
| 7,552,604 | B1 * | 6/2009 | Waldrop | D04B 21/18 66/192 |
| 7,707,857 | B1 * | 5/2010 | McMurray | D04B 1/104 66/176 |
| 8,448,475 | B2 * | 5/2013 | Akao | D04B 21/16 66/193 |
| 9,551,095 | B2 * | 1/2017 | Lee | D04B 1/18 |
| 9,567,697 | B2 * | 2/2017 | Fang | D04B 21/06 |
| 2002/0112510 | A1 | 8/2002 | Freedman | |
| 2012/0088085 | A1 | 4/2012 | Kruse | |

FOREIGN PATENT DOCUMENTS

| | | | |
|---|---|---|---|
| DE | 20309796 | U1 | 10/2003 |
| DE | 202010005217 | U1 | 8/2010 |
| EP | 0921221 | A1 | 6/1999 |
| WO | 2011064796 | A1 | 6/2011 |

* cited by examiner

Fig.: Course and Wales

Tuck stitch produced on a latch needle machine

Notations of tuck stitch

STRETCHABLE TEXTILE STAY AND TRANSFER SHEET

CROSS REFERENCE TO RELATED APPLICATIONS

This patent application is the national phase of PCT/EP2014/079463 filed Dec. 30, 2014, which claims the benefit of Dutch Patent Application No. 1040582 filed Dec. 31, 2013.

TECHNICAL FIELD

The invention relates to a stretchable stay and transfer sheet for use on mattresses, wheelchair cushions, operation tables, emergency brancards, etc.

BACKGROUND

Elderly people, chronically ill people, and persons with certain handicaps often need help to get in and out of their beds, chairs and wheelchairs. Most of this help is provided manually and requires exertion of some physical forces. It is known from literature, nursery care protocols, some applied for and some published patents (EP 20395 199 A2, WO 2011/064796 A1 CA 1224 889, CH 705247 A1) and everyday practice in nursery care, that special transfer products are and have often to be used to get these patients in and out of the bed, to limit physical loads on the care provider and on the patient itself. Examples of such special bed transfer products are woven and non-woven smooth textiles transfer sheets with polymer finishes and or lubricants such as silicone finishes which reduce friction forces, special mechanical systems to lift or sideways shift the patient out of the bed, cylindrical or tube like shape roll systems etc. Also double sets of transfer sheets made from parachute fabrics or other smooth fabrics, which are lying under the patient and glide on top of each other are often being used in everyday care practice. These sheets should be removed from underneath the patient to prevent skin problems, because the inappropriate inelastic character and structure of the surface of these sheets and the potential of occurrence of a hammock effect can lead to higher pressures, and often to skin wounds because the materials are not suitable for permanent skin contact. This nursery care protocol is often ignored in every day nursery care practice. This leads in many cases to skin problems and tissue wounds. Especially high friction forces, high shear forces and a wet skin can quite easily lead to skin damages and skin wounds, better known as bedsores, pressure sores and moisture sores.

The general disadvantage of these systems is therefore that most of them haven't been developed to have permanent contact with the skin of the patients and can't stay therefore on the mattress or cushion underneath the patient permanently. The care protocol describes that the transfer system should have a short contact to the patient to limit the load on the patient's skin and its body tissues, but even during short contact skin damages can arise, especially when the frictions and shear forces are high in dry and can even be higher in wet conditions. These present transfer systems can also enhance the pressure on the body and won't minimize these pressures and evenly distribute them, due to their inelastic behavior and the hammock effect. This implicates that the caregiver should remove the system every time from underneath the patient. This has two negative side effects.

For the patient: extra physical impact on the patient's skin.

For the care provider: extra handling time and higher exertion of forces.

As a result in everyday practice, caregivers tend to overrule the subscribed protocol and let the patient stay and lie too long on these present sheet like transfer systems. This enhances the possibilities of skin wounds, pressure sores or bedsores and moisture wounds. Other solutions such as e.g. the bed sheet disclosed in Swiss patent application CH 705247 A1 tend to overcome some of these problems but still have disadvantages such as limited water transport and no absorption capacity, an upper surface limiting active transfer when caregivers pull at the patient and no integrated barrier function to protect the underlying mattress products from getting contaminated. U.S. Pat. No. 5,735,145 A describes a multi-layer weft knit wicking fabric that comprises an integrally formed, weft knit fabric structure having first and second knit fabric layers which are secured in spaced relation to each other by a series of spacer yarns extending between the fabric layers. The first layer is a substantially hydrophobic layer knit from synthetic yarns and the second layer is a substantially hydrophilic layer knit e.g. from a natural yarn, such as cotton for example, while a plurality of moisture transporting spacer yarns are extending between the two layers to secure the layers in spaced relationship separated from each other. The hydrophobic layer is preferably a knit and welt or simple jersey knit structure. The fabric is to be used to form an item of hospital bed sheeting and not a transfer sheet. Ep 0921221 A1 reveals a knitted textile fabric having a three-dimensional structure and comprising a layer of hydrophilic yarn on a technical front face of the fabric, a layer of hydrophobic yarn on an opposite technical back face of the fabric, and a pillar stitched, low density layer of yarn extending between and joining the hydrophilic and hydrophobic yarn layers. The fabric is intended for applications, such as a bed pad, or an incontinence garment, in which it is desired to provide a body-contacting fabric surface covering a moisture absorbing layer. The layer of yarn joining the hydrophilic and the hydrophobic layers comprises tuck stitches in a pillar arrangement resulting in a rib fabric surface showing even yarn loops. This fabric has no specific low-friction surface as it would be desired for a transfer sheet. Finally, it is known e.g. from U.S. Pat. No. 6,311,525 B1 and De202010005217 U to give ordinary knitted bed sheets better elastic qualities by incorporating elastic yarns in the fabric, or by using specific stretchable knit constructions.

There is a need therefore for a permanent stay and transfer bedding article for patients in bed or in wheelchairs, based upon elastic textile knitted fabrics, guaranteeing low friction characteristics and providing a comfortable micro climate.

SUMMARY

It is an object of the invention to provide a smart textile solution to meet this need.

The invention facilitates permanent and long time staying in wheelchairs, chairs and on beds of chronically ill, less mobile and immobile patients especially in the elderly care, nursery care, rehabilitation and homecare. As an embodiment of a textile based stretchable stay and transfer layer it can cover mattresses and cushions. Technical solutions within the invention are provided to guarantee a dry skin and to control the temperature thereof, the so called control of the micro climate, to lower and evenly distribute pressures and shear forces, and moreover to enable an easy low friction movement of patients in bed or in sitting positions, and to enable transfers into the bed and transfers out of the bed. The elastic behavior of the sheet is also an important feature to alleviate and reduce the pressure and shear forces on the body The top surface of the textile invention with a low friction coefficient and the capacity to reduce shear and friction forces on top and bottom surfaces while a patient lies on it, will also minimize the pull and tear forces applied by the care provider and will also reduce transfer handling times. More important is thus the minimalizing of shear and friction forces and eventually pressure forces for the patient himself in wet and in dry conditions, leading to prevention of superficial skin wounds often resulting in decubitus or pressure sores. Also an important feature is the elastic behavior or ability to adapt itself to the pressure and shape of the body of the patient on the transfer layer, which prevents the increase of pressure due to absence of the hammock effect, the so called non-elastic behavior of an inelastic type of bed sheet. The stay and transfer sheet can be applied in different product embodiments as an active or passive stay and transfer layer. An active stay and transfer system allows the caregiver to pull at the less mobile patient lying or sitting on the sheet, to reposition him or her and pull him out of the bed and will allow body movement and repositioning of the patient himself. A passive system requires pulling at the sheet itself to move the more immobile patient sideways or upward and this version can stay permanently under the patient or can be pulled underneath the patient temporarily when needed for transfers. Finally, the invention permits attaining a further objective of the invention, namely to protect an underlying 3-dimensional spacer fabric and or foam mattress, which can be used in combination with the textile stay and transfer layer, from getting contaminated or dirty with body fluids like sweat, urine, blood and skin secretions such as fat, resulting in less washing cycles and lower usage costs of these parts.

In the list of figures below various embodiments of the invention are visualized and drawn.

The backings or surfaces of both the double knit layer and the top of the single knit low friction layer are treated with a PU-foam or spray finish/coating (e.g. Purtex.). Finally the double knit and single knit layers are interconnected via an elastic dot coating layer.

Figure 4:
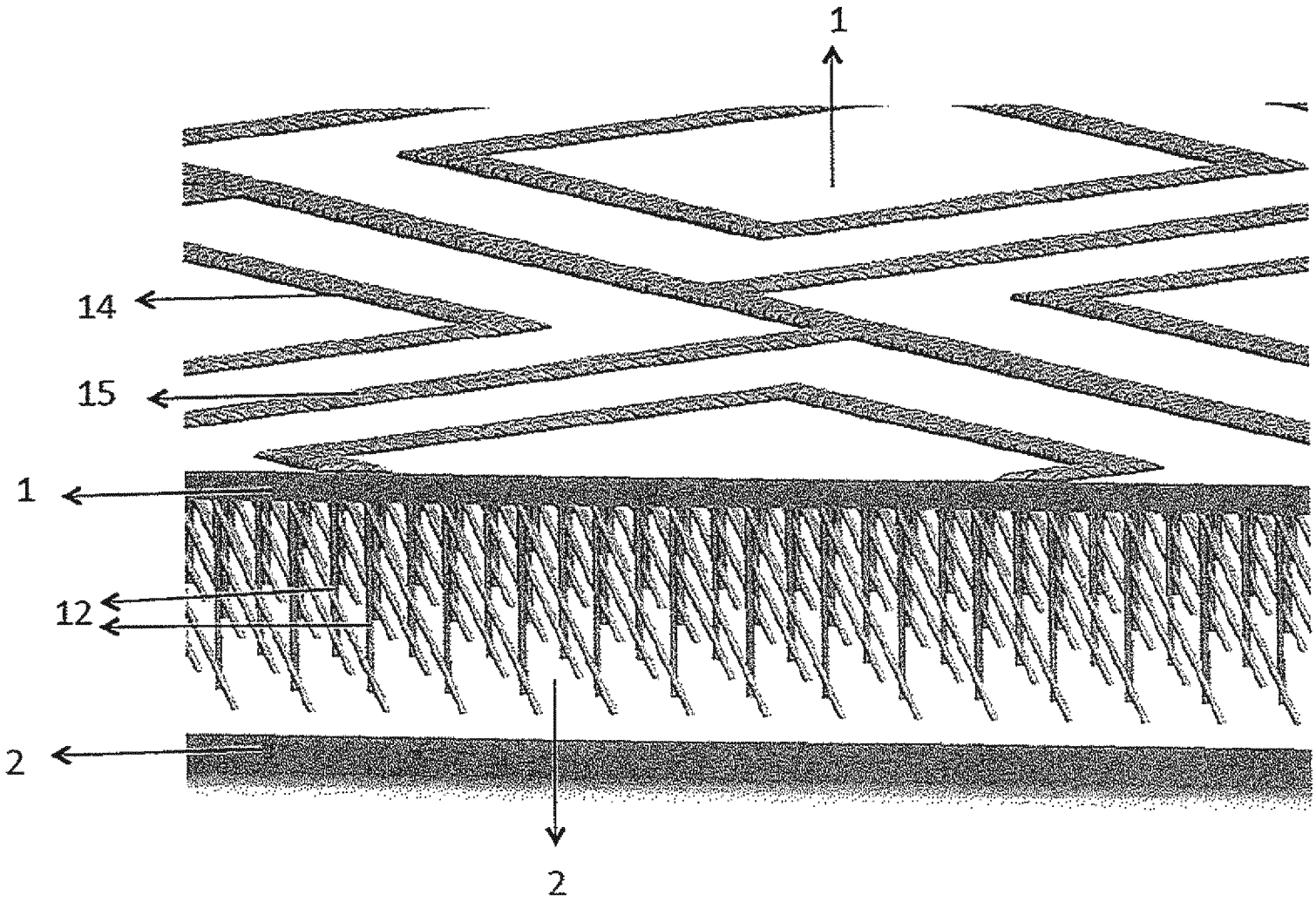

FIG. 4 shows a 3-dimensional drawing of a double knit two faced 3-dimensional structure.

Figure 5:
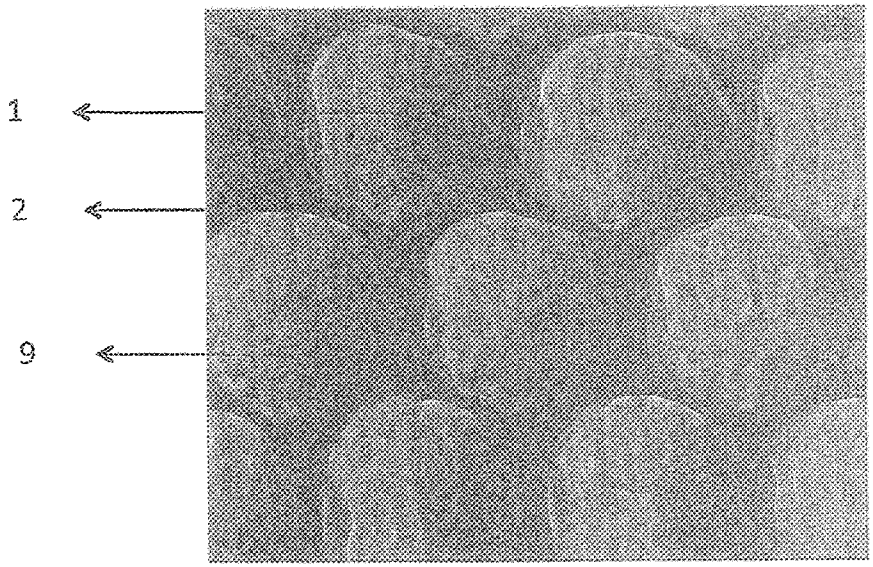

FIG. 5 shows a sketch of the topside of a possible single or double knit top layer. The topside structure of the top layer is consisting of honeycomb shaped raised areas and downward directed rims as recessed areas.

Figure 6:
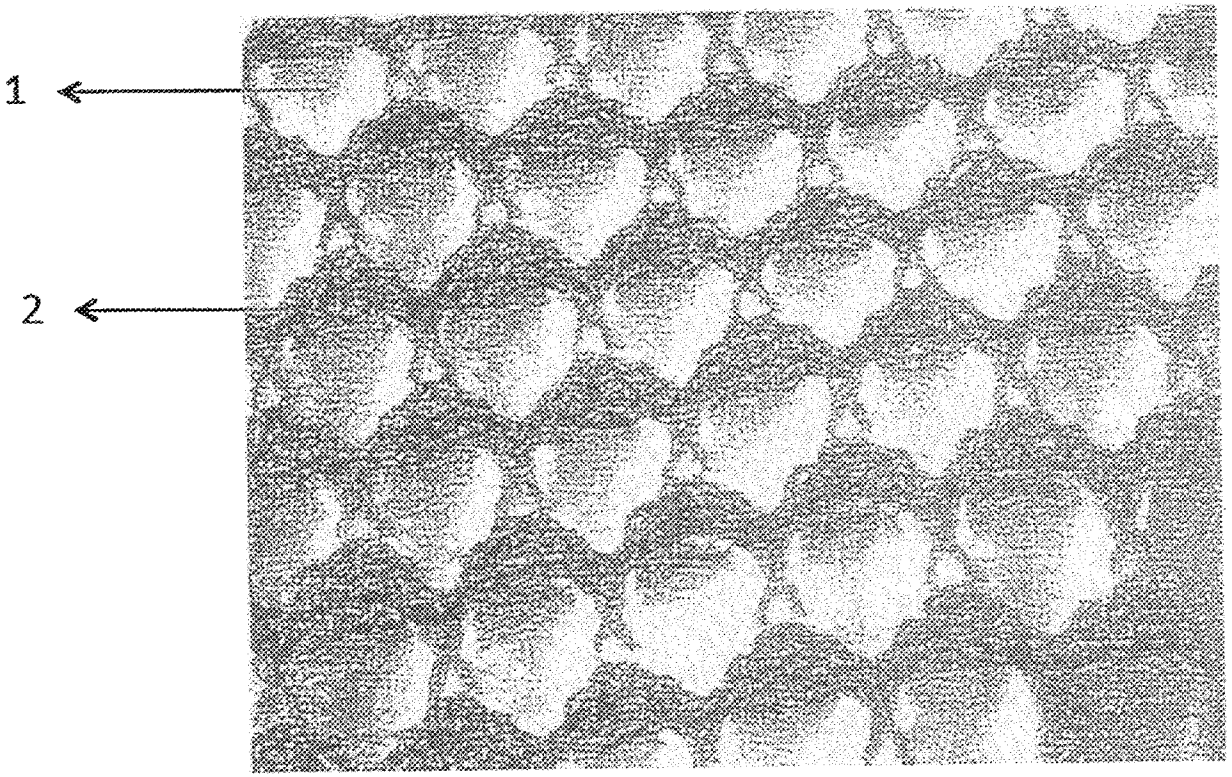

FIG. 6 shows a sketch of a possible double (single) knit top layer. The top side structure of this layer is formed by cavity shaped spherical or hexagonal octagonal structures which are surrounded by rims as raised areas.

Figure 7:
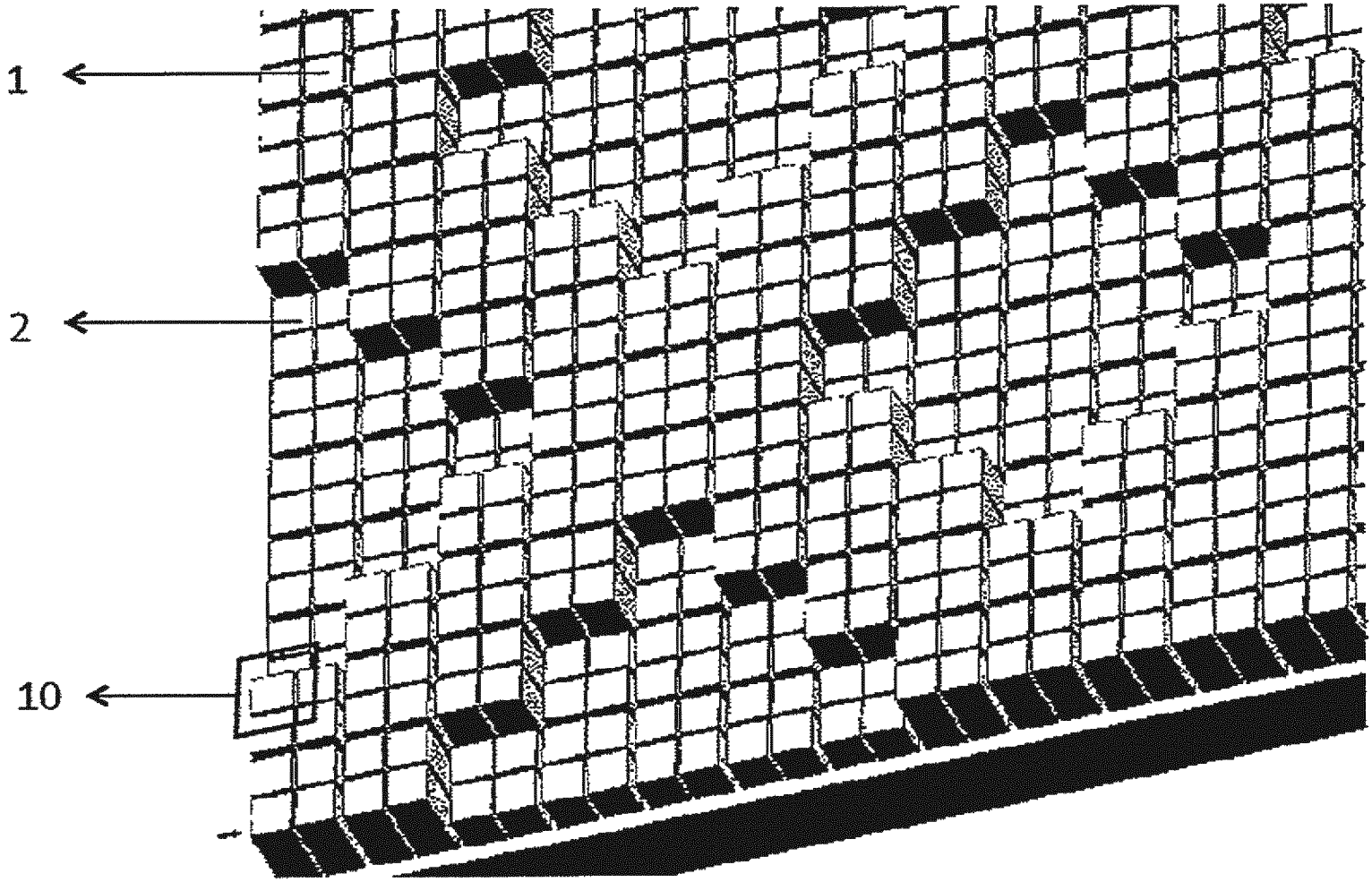

FIG. 7 shows a schematic 3D-drawing of a diamond shaped structure for the recessed areas and raised rims between the recessed areas.

Figure 8:
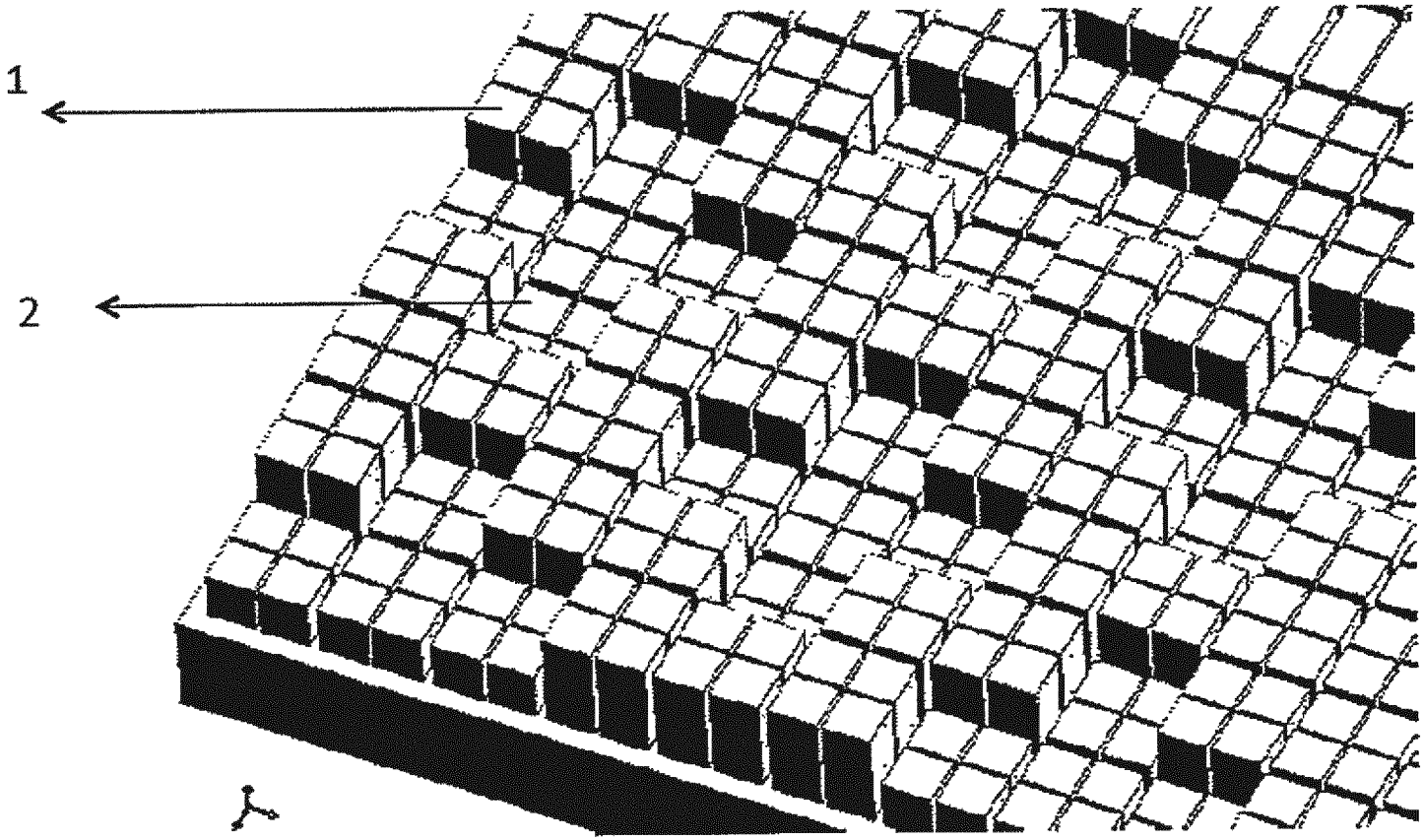

FIG. 8 shows a schematic 3D-drawing of a cross shaped structure for the recessed areas and raised rims between the recessed areas.

Figure 9:
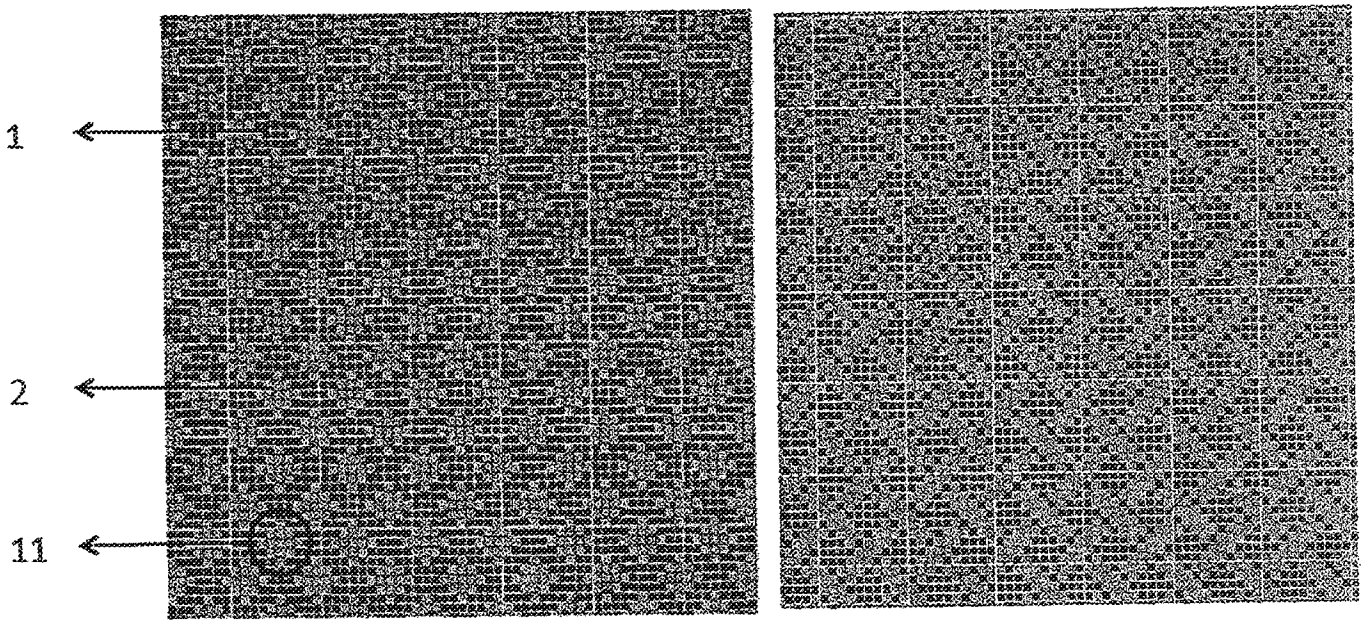

FIG. 9 shows two top views of possible raised and recessed areas under an angle of 45 degrees to the X-Y axis with square shaped recessed areas.

Figure 10:
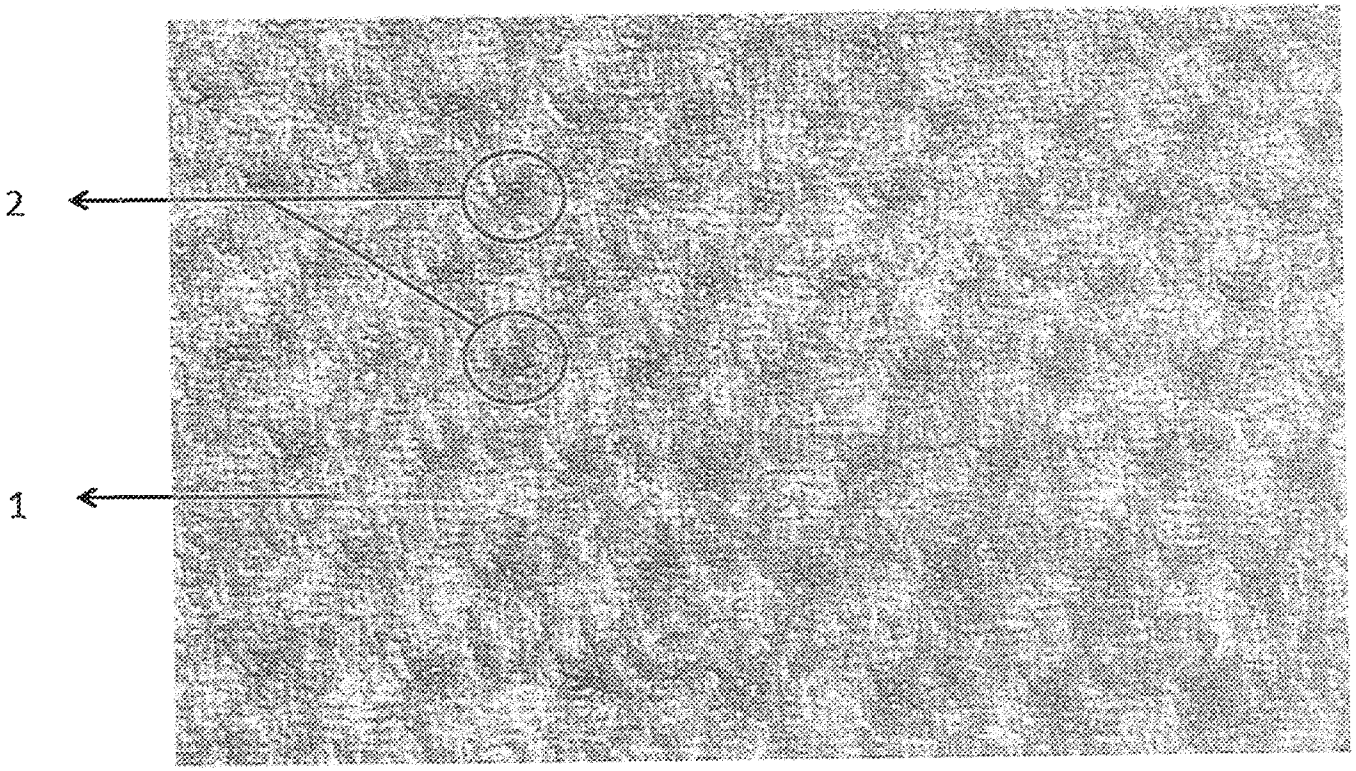

FIG. 10 shows a sketch of an example of a possible double knit velours structure.

Figure 11:
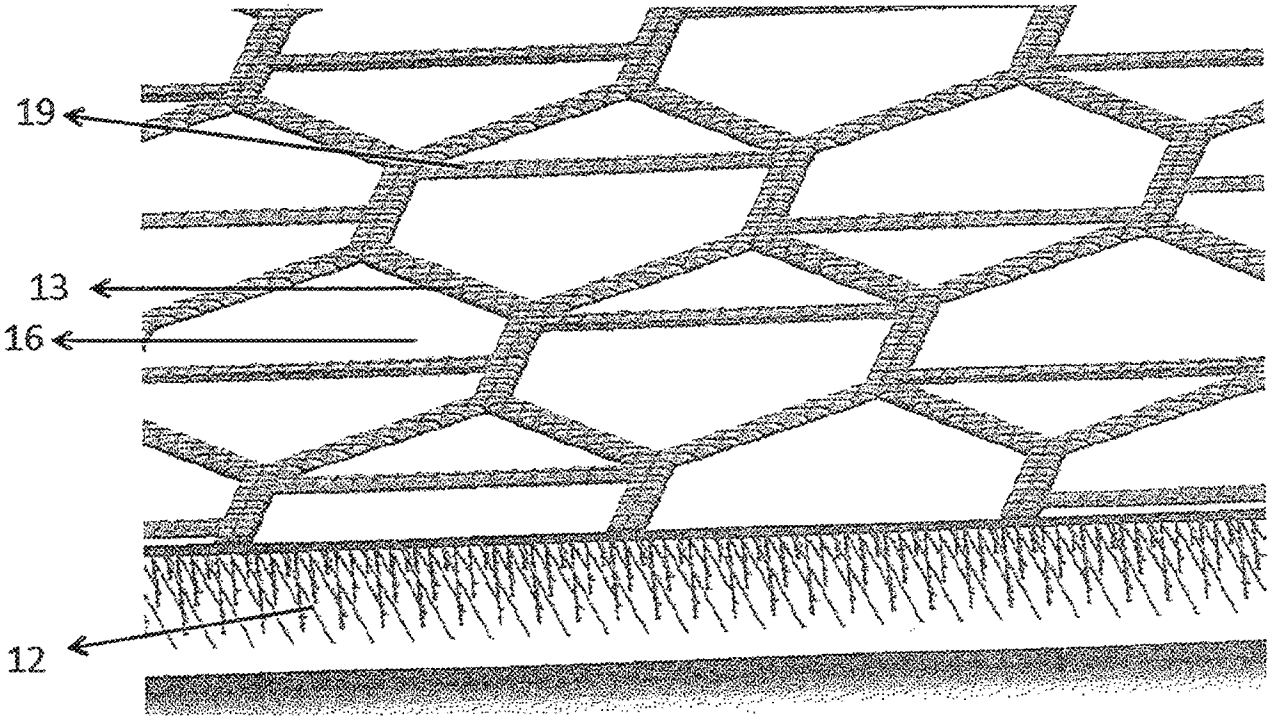

FIG. 11 shows a 3 dimensional sketch/drawing of the top surface and cross section of a double knit two plane 3-dimensional spacer fabric structure.

Figure 12:
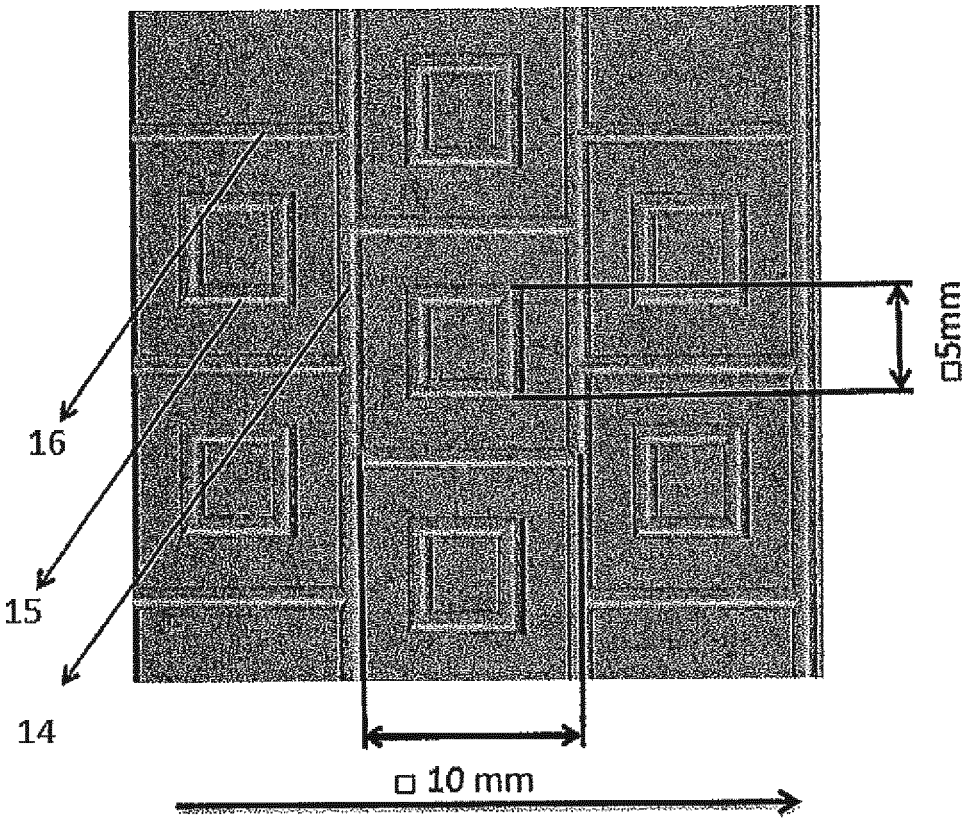

FIG. 12 shows a schematic 3-dimensional drawing of the top surface of a double knit two plane 3-dimensional structure with raised squares.

Figure 13:
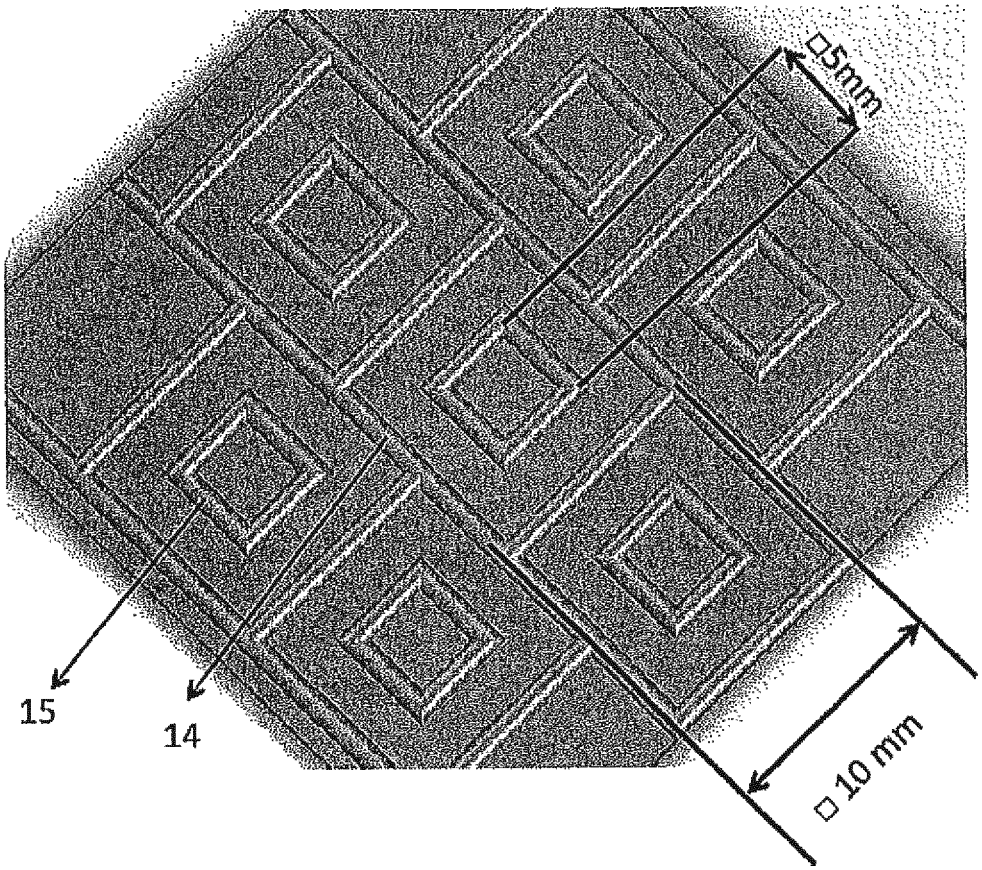

FIG. 13 shows a schematic 3-dimensional drawing of the top surface of a double knit two faced 3-dimensional structure with raised rotated squares.

Figure 14:
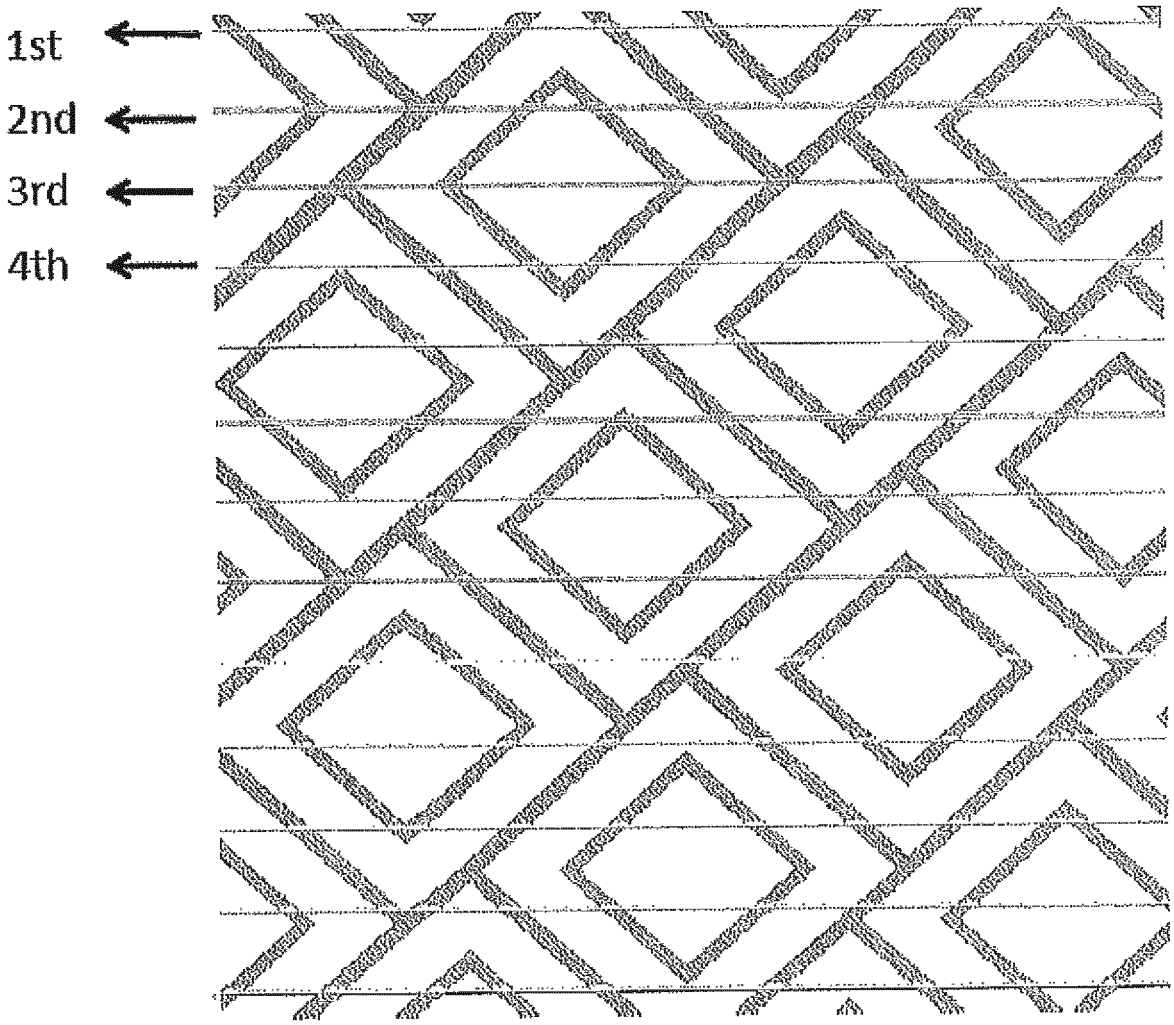

FIG. 14 shows a top view of the top surface of a double knit two faced 3-dimensional structure with the raised rotated diamonds, squares.

Figure 15:
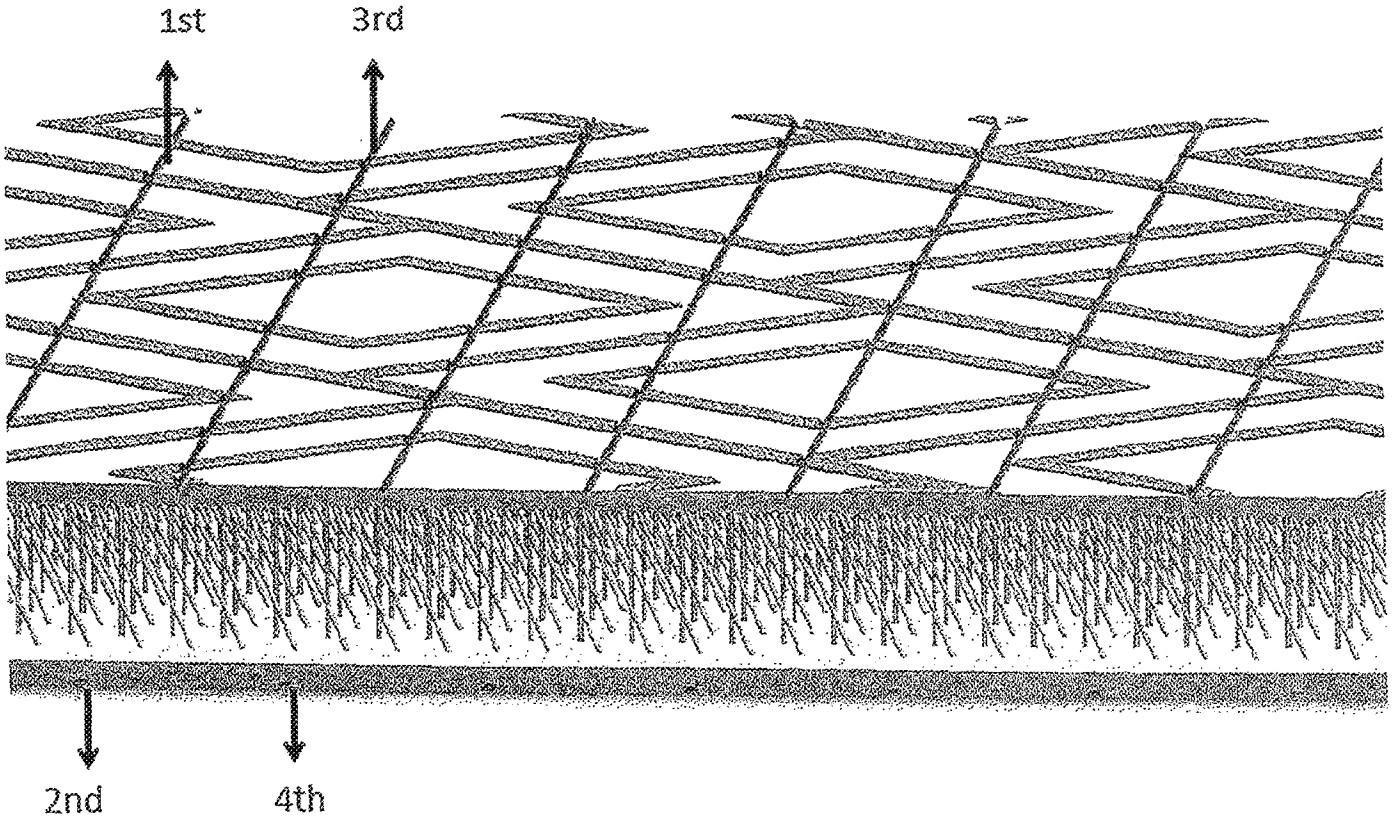

FIG. 15 shows a 3-dimensional view and side view of a double knit two faced 3-dimensional structure with the raised rotated diamond, squares and the recessed lines crossing these.

Figure 16:
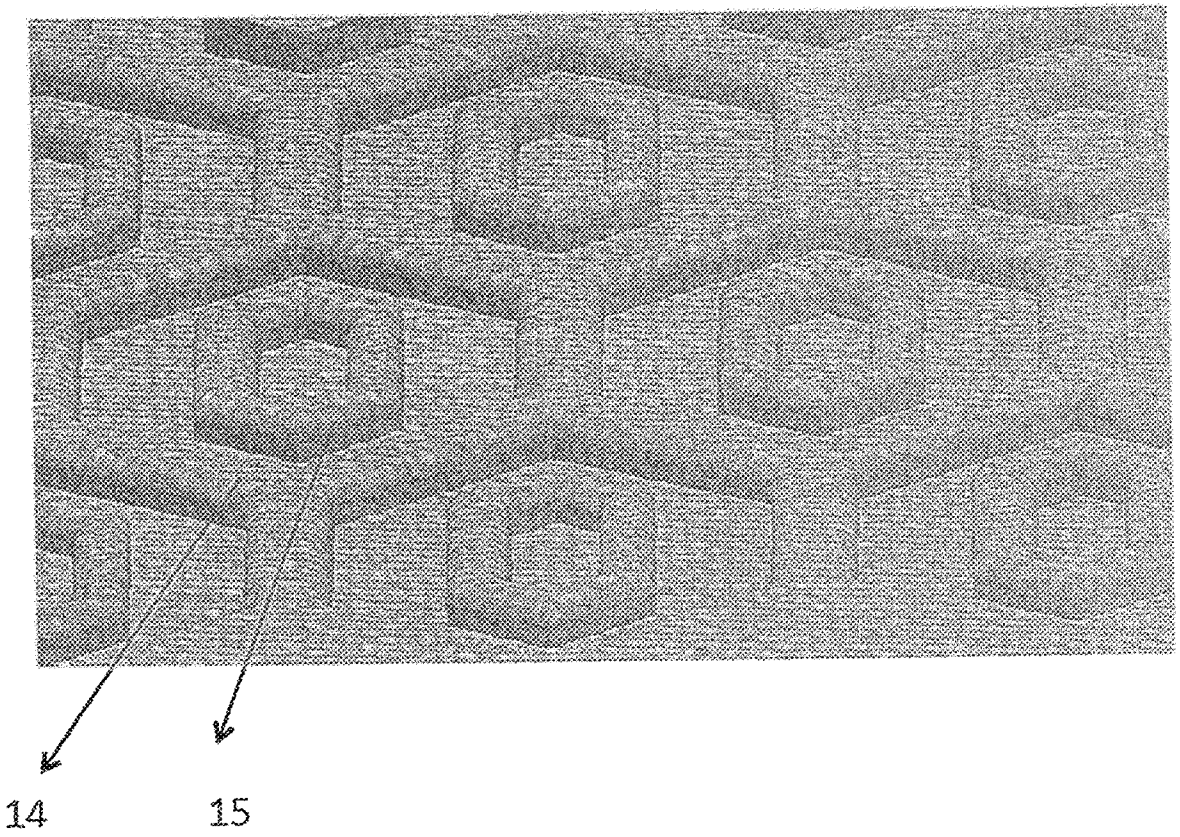

FIG. 16 shows a schematic 3-dimensional drawing of the top surface of a double knit two faced 3-dimensional structure with raised honeycomb lines.

Figure 17:
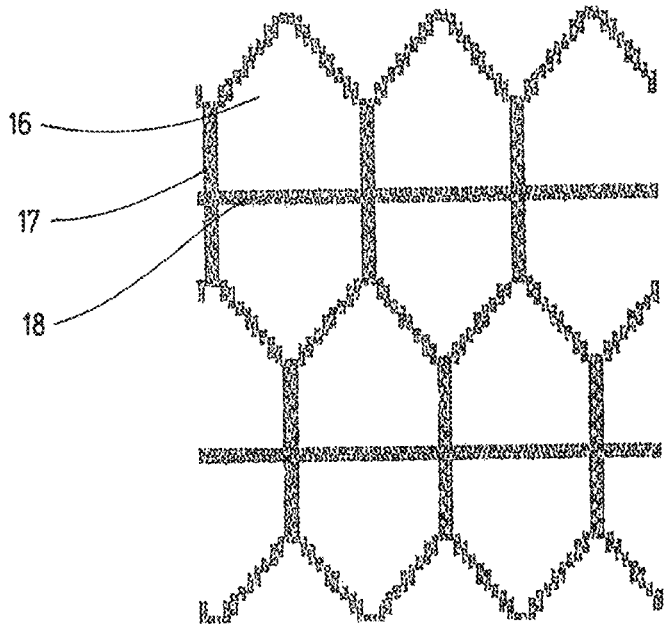

FIG. 17 shows a top view and also knitting pattern of the honeycomb structure on the double knit 3-dimensional structure as raised structure with horizontal extra gliding lines dividing the honeycombs in half.

Figure 18:
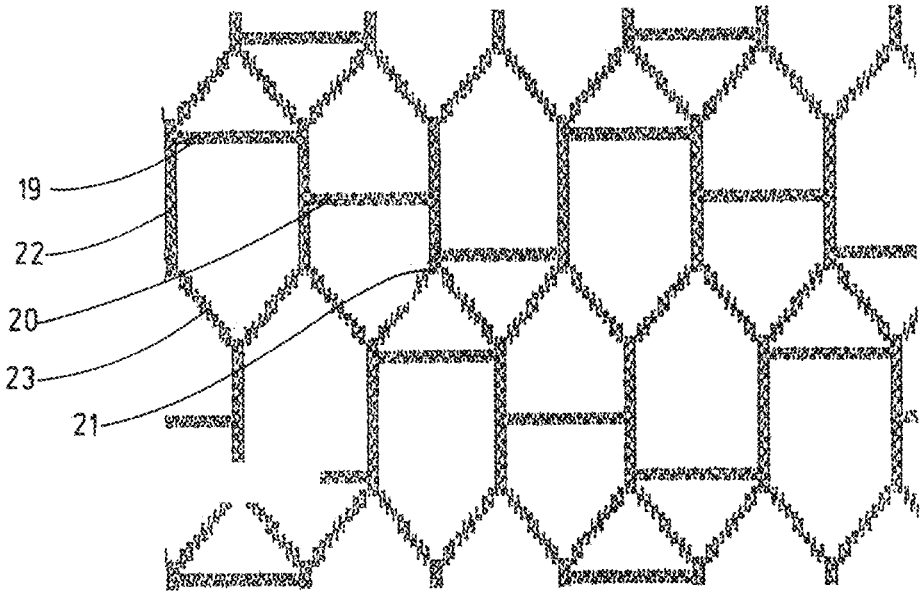

FIG. 18 shows a top view and also knitting pattern of the honeycomb structure on the double knit 3-dimensional structure as raised structure with a horizontal extra stepped gliding lines varying from vertical position starting either at the edges of the honeycomb and a halfway dividing position.

Figure 19:
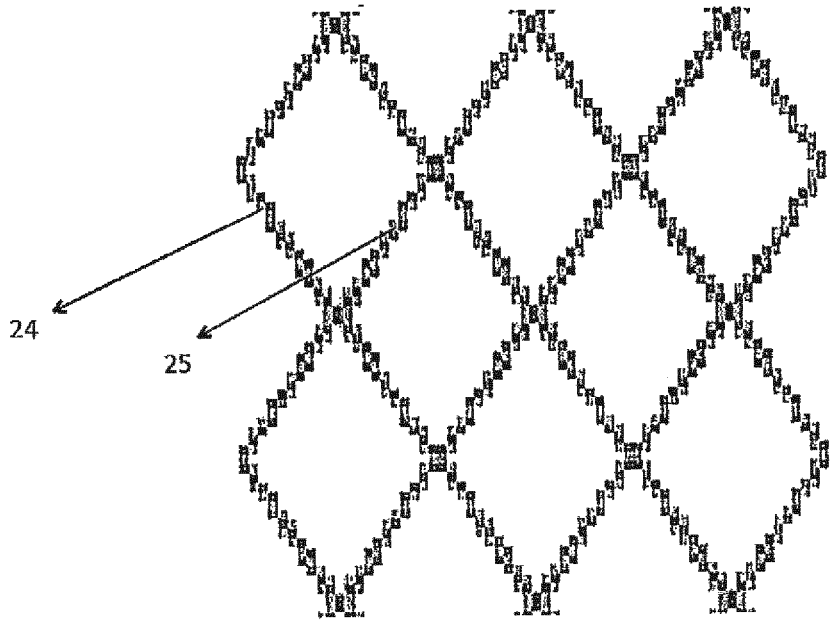

FIG. 19 shows a top view and also knitting pattern of a small diamond structure on the double knit 3-dimensional structure as raised structure interconnected to each other.

Figure 20:
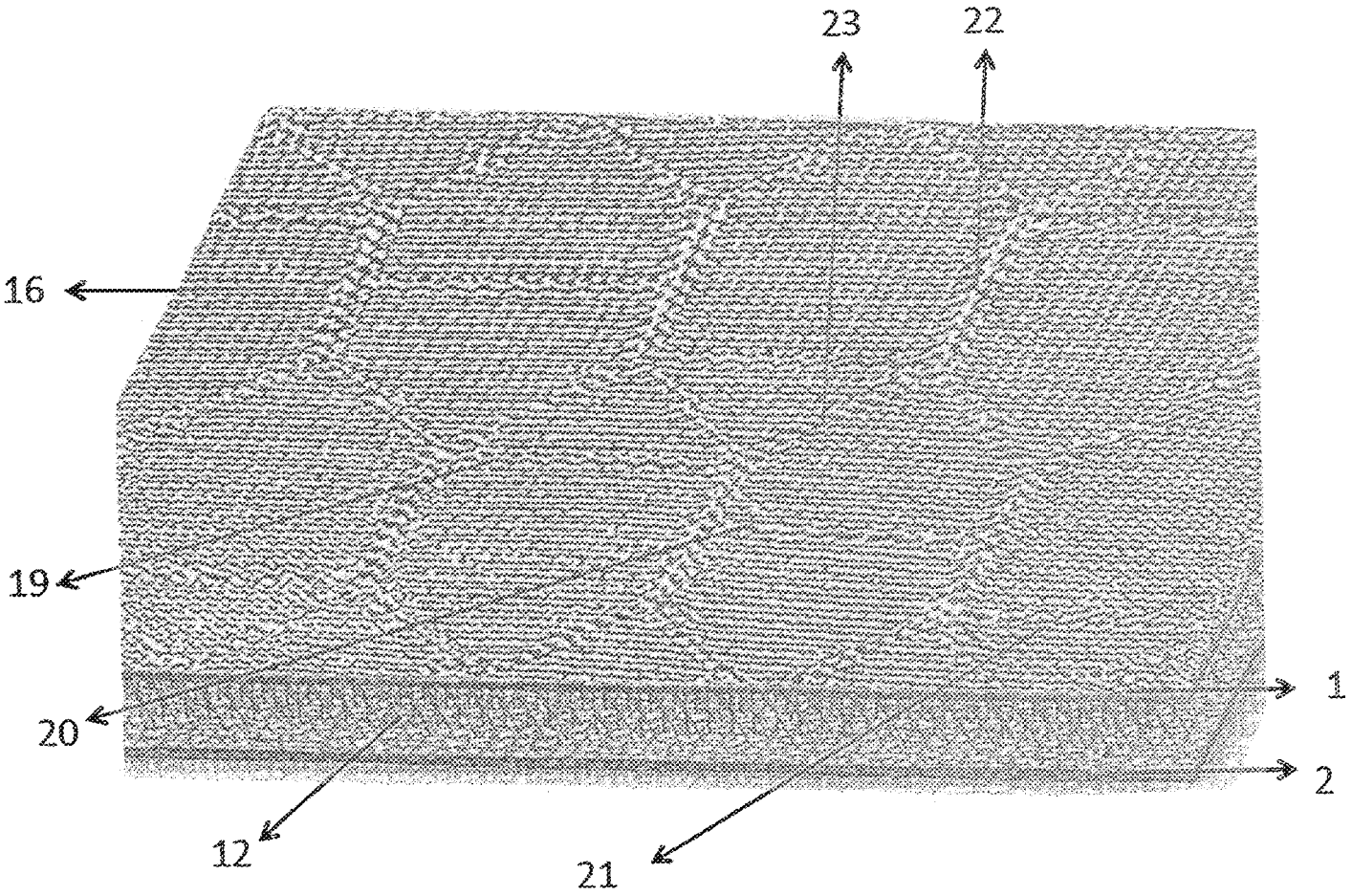

FIG. 20 shows a 3-dimensional drawing of the raised structure of FIG. 18 with three stepped horizontal gliding lines.

Figure 21:
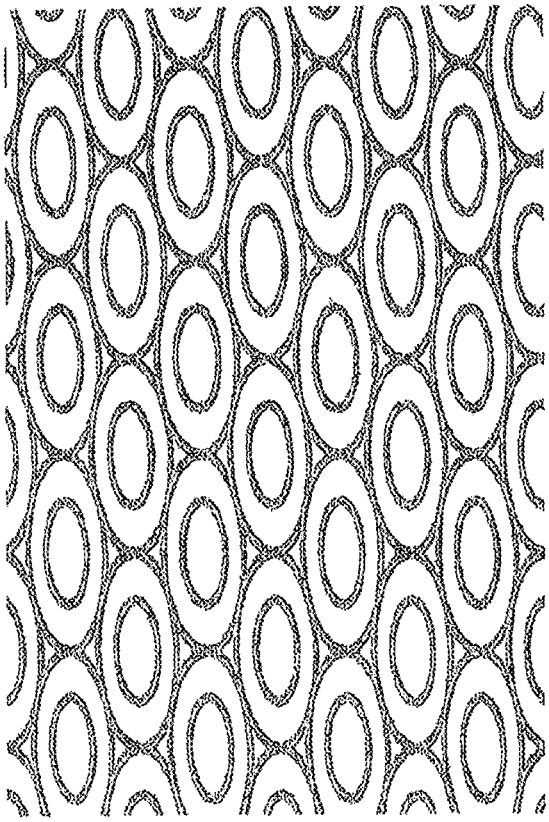
Figure 22:
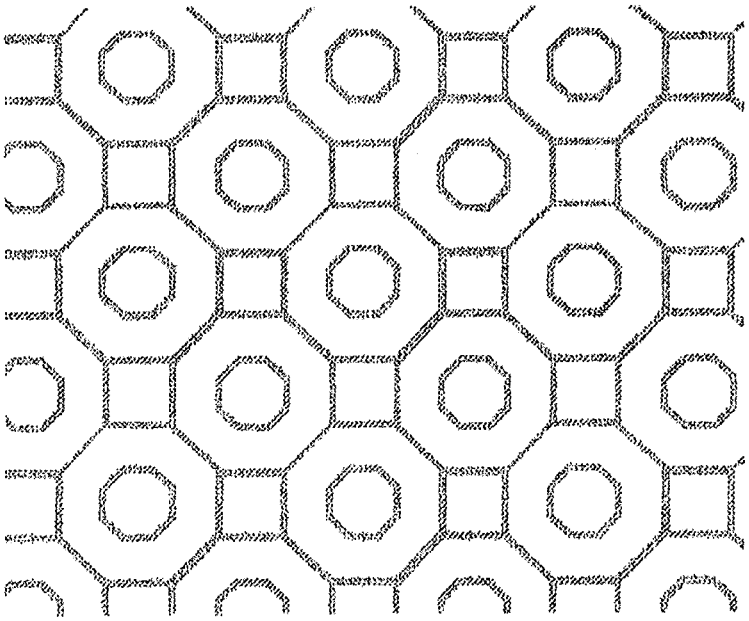

FIG. 21 shows a raised structure pattern of interconnected circular elements, which can also be oval of shape FIG. 22 shows a raised structure pattern of interconnected octagonal and square elements.

Figure 23:
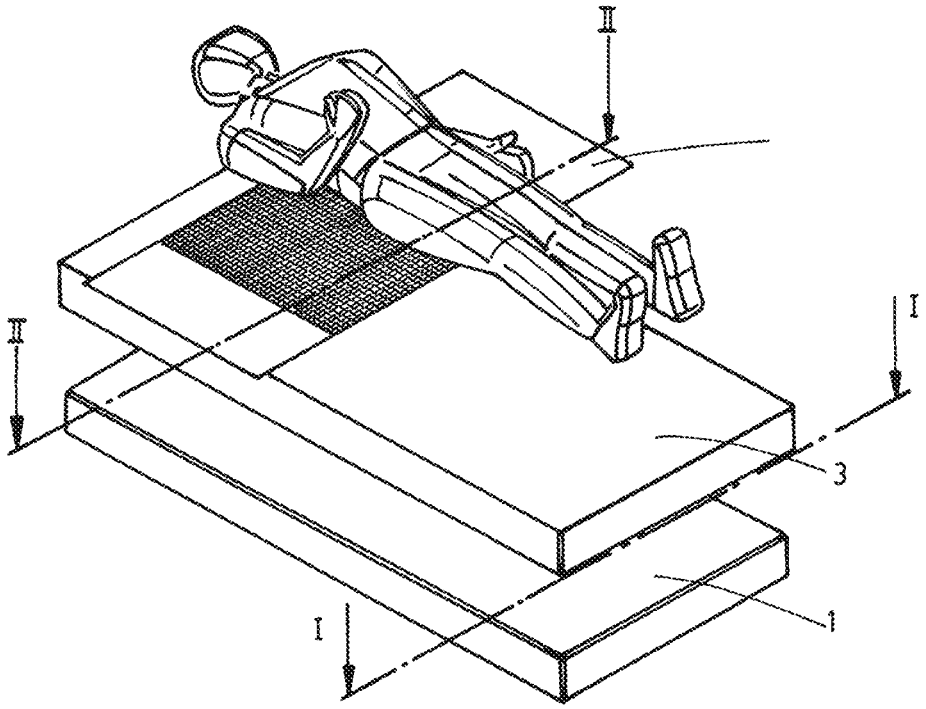

FIG. 23 illustrates the possible use of the active stay and transfer layer 2 and passive transfer sheet 3.

Figure 24:
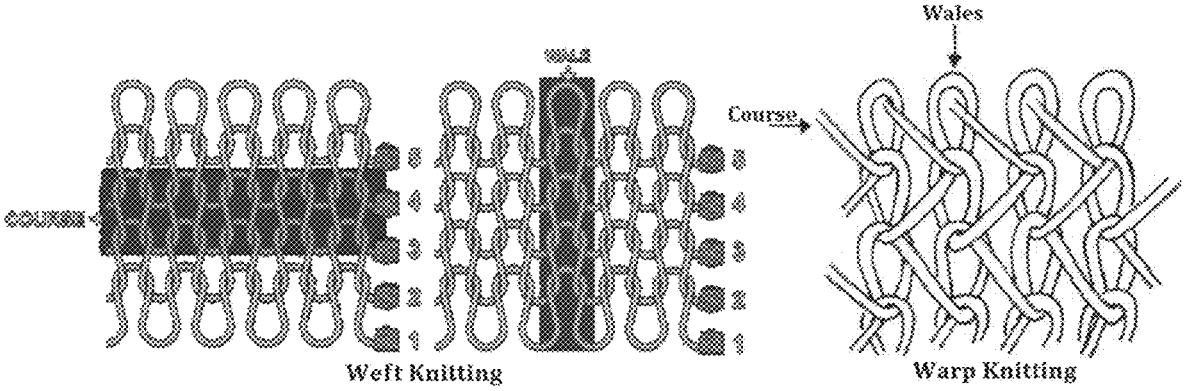

FIG. 24 illustrates stitch courses and stitch wales in knitting approaches.

Figure 25:
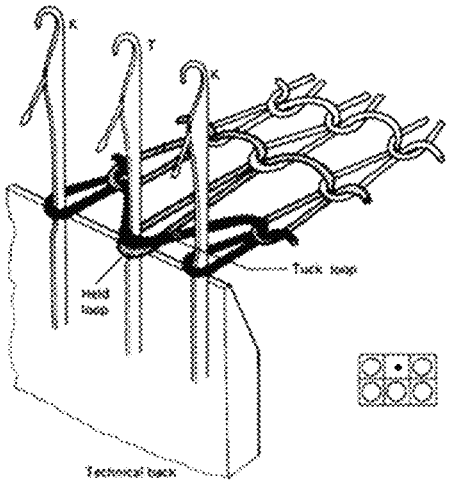
Figure 25:
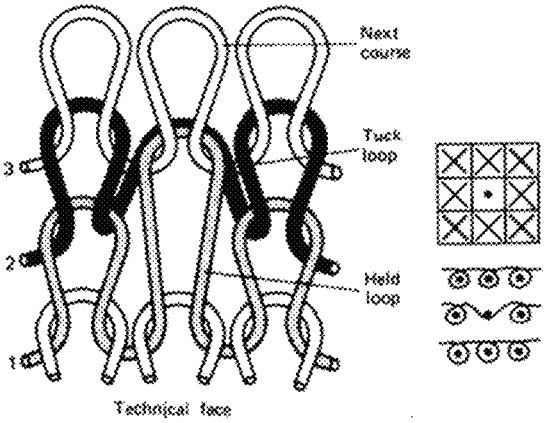

FIG. 25 illustrates a tuck stitch.

DETAILED DESCRIPTION OF FIGURES

Figure 1:
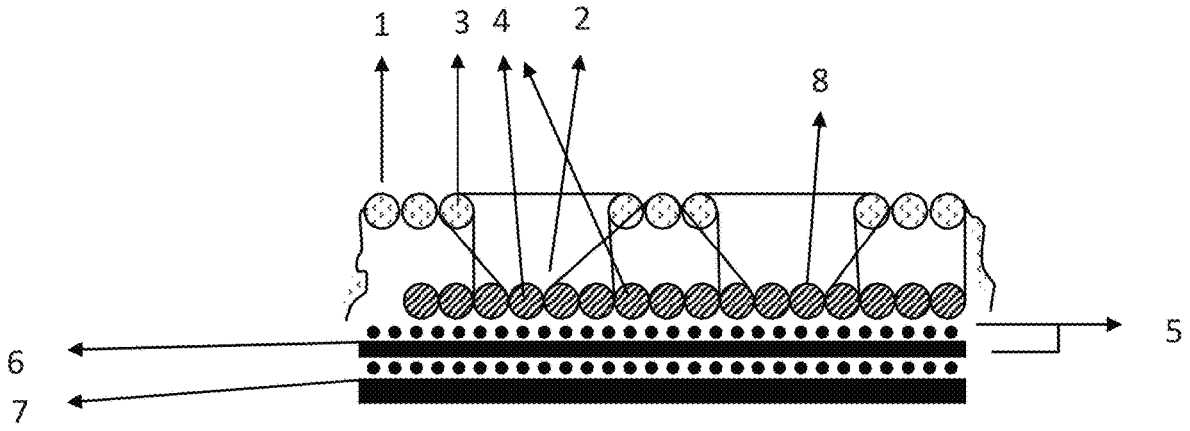
FIG. 1 shows a schematic drawing of a 3 layer stay and transfer sheet (from top to bottom: double knit two faced knitted structure, membrane layer, single knit low friction layer). The double knit layer of the stay-transfer and bed sheet is interconnected via an elastic glue layer to an intermediate membrane layer and via a second elastic glue layer to a bottom single knit low friction layer.

In FIG. 1 one can see that one type of a preferred embodiment for a 3-layer transfer and stay sheet has as a base structure a double knit two faced knitted jacquard fabric constructed with two different yarns interconnected to each other in an as one piece knitted structure, but can also be manufactured as a single knit two faced knitted jacquard fabric. One can distinguish in this top layer, the raised areas 1 and the recessed areas 2. The yarns 3 for the raised areas 1 are polymer yarns, such as PET yarns. The yarns 4 for the recessed areas 2 are also polymer, synthetic yarns such as PET yarns, but also PA yarns can be used in one or both of the layers. The difference in diameter and the difference in the number or quantity of individual yarn filaments between yarn 3 and yarn 4 creates a distinguishing difference in the capillary structure enabling fast transport of water and liquid from the top layer 1 of this double knit structure to the bottom layer 2. The recessed areas 2 with a width of a minimum of one stitch or knitting course (0.5-1 mm) to a maximum of 5-10 stitch courses, and a depth of 0.5 mm to a maximum of 3 mm, are surrounded by so called protruding walls 8 with a corresponding height creating a knitted cavity. This cavity has a multi-purpose function. The recessed areas 2 within the cavity don't have direct contact to the skin, forcing the skin to slide on the smooth raised rims during movement in bed and in and out of the bed. This limits the friction forces applied to the skin during transfer handling and the stick and slip effects when the skin has contact with a larger sliding surface. The second function of the cavity is to provide ventilation. The third function is the ability to absorb larger quantities of water than single knit fabrics and single woven fabrics. The water (sweat, urine) will accumulate between the yarns 4 in the recessed areas 2, and this combined with the capillary transport systems and the body temperature will result in fast drying of the raised areas and the recessed areas and guarantee a dry skin. The yarns 3 and 4 don't consist of one single fiber but are composed of a number of individual filaments twirled together as one yarn. The yarns 3 are preferably non-texturized, smooth yarns and from a certain diameter/thickness with low amount of filaments, which is respectively higher and lower than those of yarn 4. This is done to enhance water and fluid transport. The yarns 4 are texturized yarns from a smaller thickness with a high amount of filaments in order to enhance the number of capillaries of the same compared to those of yarn 3.

The double knit or single structure has an elastic behaviour which can be enhanced additionally by applying an elastic yarn or elastomer yarn, such as e.g. elastan. This also applies to the double 3-dimensional structure as mentioned earlier in the description of the invention with the interconnection monofilament and or multifilament yarns between the top and bottom plane.

The double knit layer with top layer 1 and bottom layer or surface 2 in this possible embodiment are dot coated with glue dots, stripes or other glue patterns 5 to an elastic membrane layer 6, which blocks the water, but allows passage of water vapour and gases etc. The membrane 6 can be a monolithic elastic PUR membrane, a PET membrane, a PU membrane an electrospun nanofiber membrane, a PTFE membrane, a PUR layer applied via spraying or foam process (see FIGS. 2 and 3), a PUR layer applied with ultrasonic treatment, a C4 or C6 Fluorcarbon layer, a silicone based finish, a dendrimer based finish which is very hydrophobic.

This membrane layer 6 is dot glue coated with part 5 to a low friction single knit layer 7, which ensures low shear force sliding of the transfer and stay sheet on the underlying 3-dimensional textile mattress underneath and protects the membrane or water blocking layer from getting damaged during use. In order to ensure a low friction transfer the single knit layer 7 is composed of smooth PET-yarn, single knitted viscose yarn, PA11 yarn or combinations thereof.

Based on the above described structures, different compositions can be developed for specific applications. In one embodiment for an active transfer and stay sheet there is a need for controlled but sufficient elasticity of 10-30% of the sheet that can be achieved by controlled guiding of the elasticity of the knitted fabrics via the knitting process itself and application of elastomeric yarn, but also by the variation in density and dispersion of the glue coating dots or glue stripes, lines 5. More glue dots will limit the elasticity and less glue dots or lines will enable elasticity more, also the size of the dots have impact on the elasticity. The stretching or elongation of the elastic sheet due to e.g. the pressure and contour of the human body will press these glue dots or stripes outwardly in case they have a non-elastic behaviour, creating an additional pattern of raised points, rims or planes in the upper structure which can be used as gliding structures on the bottom side of the complete stay and transfer a sheet. Another method to limit and control the elasticity is the application of printed silicone and or polyurethane lines and grid patterns on the top and or bottom surface of the described fabrics, or as an intermediate gluing layer. This grid like pattern can also have an extra function as pressure and shear forces distributing materials.

The elasticity value also depends on the type of embodiment of the invention. For the embodiments of an active stay and transfer layer a higher elasticity, is required as described above. For passive stay and transfer sheets, a low elasticity is required due to the pulling at this sheet by the nurse or caregiver, in the range of 5-10%.

This active transfer and stay sheet on which the patient lies has an overall neutral or positive effect on the pressure reduction of the human body and protects the 3-dimensional textile and foam mattress underneath from getting contaminated.

The active stay and transfer sheet can get a production finish on the double top sheet with brushed rims to enhance gliding characteristics and smoothness.

The double knit, two faced top structure of this 3-layer system in FIG. 1 can be produced on a double knit jacquard machine, or on a double knit interlock "8 lock" ("schloss") machine with loops (frotté), later to be transformed into a velours structure. In the finishing process of the manufacturing of the top fabric the height of the raised structure can be determined in case of a final velours structure.

Figure 2:
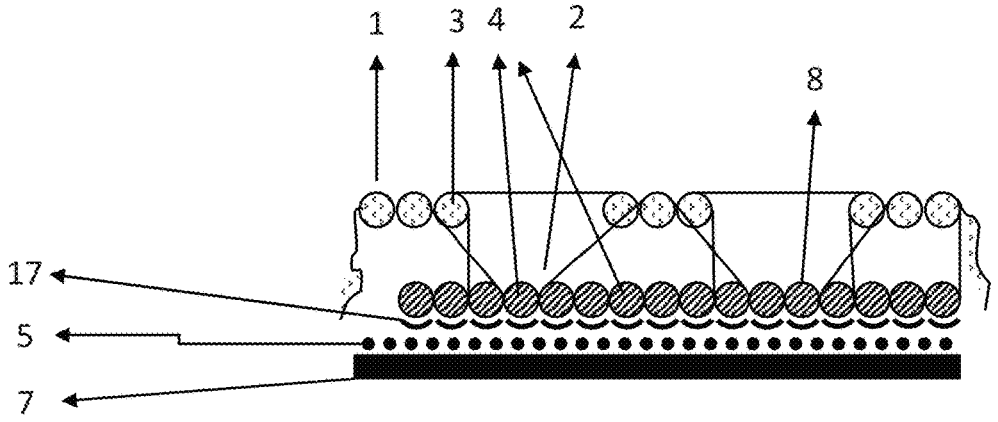
FIG. 2 shows a schematic drawing of a two faced stay and transfer sheet (from top to bottom: double knit two faced knitted structure, single knit low friction layer). The backing of the double knit layer is treated with a PU-foam or spray coating. (e.g. a so called Polyurethane finish layer from e.g Purtex or another type such as dendrimer based foam or spray coating). Finally the double knit and a very smooth single knit layer are interconnected via an elastic glue layer, which can be a so called dot coating.

FIG. 2 shows a double layer, 2-layered structure in which the membrane is replaced by a poly urethane (PUR) finish or coating 17 which is applied on the bottom side 2 of the double knitted structure. This PUR layer blocks water, but ensures water vapour and gas transport. Via a dot glue coating 5 the PUR blocking layer 17 is connected again to a single knit layer 7 with low friction characteristics to ensure easy sliding on other materials and to limit shear forces.

Figure 3:
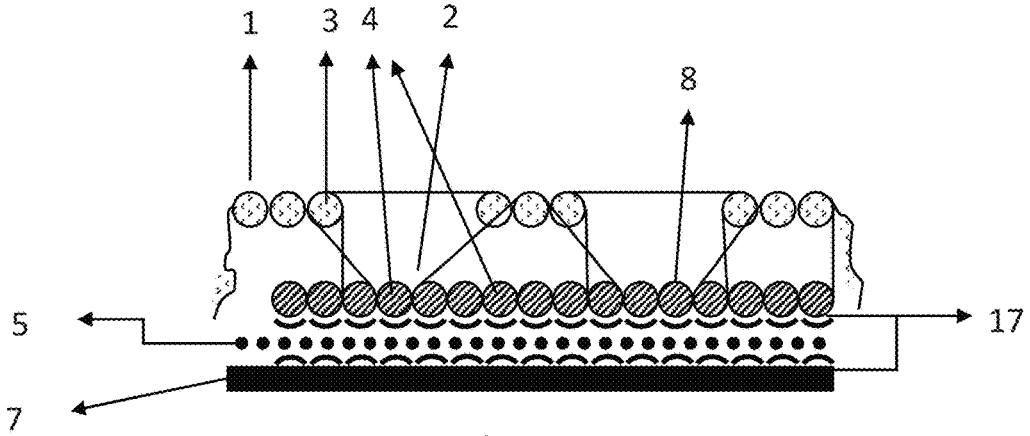
FIG. 3 shows a schematic drawing of a two layer stay and transfer-sheet using a double PU-finish layer (from top to bottom: double knit-, single knit low friction layer)

FIG. 3 shows a double layer, 2-layered structure in which the membrane is replaced by a PUR coating 17, which is both applied on the bottom side 2 of the double knitted structure and on the top side of the single knit layer 7. These two PUR layers block water even more efficiently, but ensure also water vapour and gas transport in case of saturation. Via a dot glue coating 5 the PUR blocking layers 17 are connected to each other, connecting again also the single knit layer 7 with low friction characteristics to the two layered knitted upper structure to ensure easy sliding on other materials and to limit shear forces.

Another embodiment of this double layered circular knitted structure is not visualized but represented largely by FIG. 2. The membrane in the sandwich construction is replaced by a Poly Urethane (PUR) finish 17 which blocks water and liquid, but is in this embodiment not covered at the bottom side by a single knit fabric.

FIG. 4 shows a 3-dimensional drawing with a cross section of a double knit two plane 3-dimensional structure, which is one other important embodiment of the invention. This double knit two faced structure consists of a top layer 1 consisting of smooth multifilament polymer yarns and knitted lps of the interconnecting monofilament and or multifilament yarn 12 which are knitted to the bottom surface layer 2, which consist of similar types of multifilament yarns with a higher capillary ratio as described above. This two plane 3-dimensional structure is elastic in its nature due to circular knitting process resulting in knitting loops or stitches which can be elongated in 3 dimensions, but also can get a higher elasticity via the application of a small percentage in the fabric of elastomeric yarn. On the top surface of this two plane 3-dimensional circular knitted structure raised structure 14 and 15 can be knitted in the same process. This is done by creating a specific tuck stitch consisting of one yarn which is a tuck stitch of the same polymer yarn in the top surface, which produce one larger loop bound together by a knitting stitch giving the raised structure. This so called tuck stitch with raised structure looks a bit like embroidery, but is created directly in the same circular knitting process, resulting in a raised structure, with better gliding characteristics and lower friction forces than a complete flat surface. These raised structures on the 3-dimensional knitted are visualized in FIGS. 11, 12, 13, and 14. And also in FIG. 11 till 22.

FIG. 5 shows a 3-dimensional sketch of the topside of a possible single or double knit top layer, which can act as sliding and skin contact top side layer for the patient. The structure of this layer is consisting of honeycomb, a bit spherical shaped raised areas 1 and inward directed rims as recessed areas 2. One can see in the photograph the single knits (knitted loops) or stitches 9.

FIG. 6 shows a 3-dimensional sketch of a possible single or double knit top layer. The top side structure of this layer is formed by raised areas shaped as rims, structures 2, which surround cavities 1 shaped as honeycombs, hexagonals or octogonals. It is clear that for the examples in visualized in FIGS. 4 and 5 also other shaped structures are possible to be knitted in a double knit structure creating raised areas 1 and recessed areas 2 in the same manner (diamond shaped, cross shaped, oval, circle shaped etc.).

FIG. 7 shows a schematic 3D-drawing of a diamond shaped structure for the recessed areas 2 and raised rims 1 between the recessed diamond shaped areas 2. Every cubic 10 represents in this drawing at least one individual yarn stitch. Depending on the number of fibers per inch which is determined by the type of knitting machine the fineness and consequently the smoothness of the double knit fabric can be determined. This fineness has a range from 20-70 yarns per inch. The width of the schematically drawn rims can theoretically be one yarn wide (represents one cubic).

FIG. 8 shows a schematic 3D-drawing of a cross shaped structure for the recessed areas 2 and raised rims 1 between the recessed areas 2, in which every cubic also represents one yarn stitch.

FIG. 9 shows two top views of possible raised 1 and recessed areas 2 arranged under an angle of 45 degrees to the X-Y axis of the complete bed sheet with individual squares shown in the circle indicated by number 11.

FIG. 10 shows a sketch of an example of a possible double knit velours structure with raised areas 1 and recessed diamond or cross shaped areas 2. This velours structure can be used as top layer for a passive transfer layer on which the patient is lying but is not sliding during transfer, because the caregiver will pull at this transfer layer. Another embodiment is the use of this velours top layer with raised and recessed area as skin contact double plane layer in a three, layer structure, in which the intermediate layer can either be an extra water absorbing layer such as described in the second alinea on page 6 or a water blocking layer. The bottom layer of the three layer composition can be either a smooth single knit fabric, a barrier layer (PUR membrane, PUR spray or foam finish) or both. This velours structure can be used as top layer for a passive stay and transfer sheet, but also as a top layer for a washable underpad product with a connected intermediate water absorbing layer, such as the described knitted structure with appr. 20% cotton and 80% PET fibers, or a non-woven composition, or a super micro knitted fabric combined with viscose (80%/20%) and a waterproof, breathable membrane with backing layer.

FIG. 11 shows a 3-dimensional drawing of the top surface and cross section of a double knit two plane 3-dimensional structure, with a top surface with honeycomb shaped raised structures 13 which act as gliding or sliding lines and which are formed by the creation of larger double knitting loops during the knitting process which result finally in the raised rim shaped structures which can have a honeycomb shape, a square or rectangular shape, a diamond shape, These raised honeycomb shaped or hexagonal shaped structures 13 form boundaries for recessed areas 16, which are divided by extra horizontal gliding or sliding lines 19 which can be positioned on various positions in the honeycombs 13, horizontally, vertically or under an angle to the side of the honeycomb structure 13. The top and bottom plane of this 3-dimensional circular knitted structure are interconnected by the monofilament yarn 12, which can also be partly multifilament yarns 12 or can consist of joining of one monofilament yarn and one multifilament yarn in every stitch together, maintaining by this a sufficient pressure distribution capacity and capillary structure and water transport capacity to the bottom plane.

FIG. 12 shows a top view of the top of a double knit two faced 3-dimensional structure, with rectangular or square shaped raised structures 14 and 15 which are formed by the creation of larger, tuck stitches or loops in the areas where a raised line has to be created during the knitting process which result finally in the raised rim shaped structures after pulling these longer knitting loops tighter to the rest of the top surface which are the recessed sections. The sides of the square 16 parallel to the production direction indicated by the arrow can be made of a different, thinner and a more smoother yarn to enhance the gliding characteristics. The top and bottom plane of this 3-dimensional circular knitted structure are interconnected by the monofilament yarns and or multifilament yarns.

FIG. 13 shows a top view of the top of a double knit two faced 3-dimensional structure, with 45 degrees rotated rectangular or square shaped raised structures 14 and 15, relative to the production direction of the circular knitting machine, which are again formed by the creation of larger knitting loops in the areas where a raised line has to be created during the knitting process which result finally in the raised rim shaped structures after pulling these longer knitting loops tighter to the rest of the top surface which are the recessed sections. The top and bottom plane of this 3-dimensional circular knitted structure are interconnected by the monofilament yarns and or multifilament yarns. Via the 45 degree rotated design of FIG. 13 the special stitches are structured in such a way that smooth gliding properties in x and y direction are obtained.

FIG. 14 shows a top view the top surface of a double knit 3-dimensional structure with the raised rotated diamond, squares. With the design as seen in FIGS. 13 and 14 the special raised stitches are structured in such a way that smooth gliding properties in x and y direction are obtained, what can be seen as innovative. Double knit two plane textile products have smooth gliding properties in the length but quite poor in the width, what is not acceptable for transfers and preventing of shear and friction forces on the skin. These diamond or 45 degrees rotated squares are combined with the feeding of a thinner multifilament yarns indicated by the texts $1^{st}$, $2^{nd}$, $3^{rd}$ and $4^{th}$ in FIG. 14, which enables elongation and elasticity, prevent folds and wrinkles after washing etc.

FIG. 15 shows a 3-dimensional view and side view of a double knit two plane 3-dimensional structure with the raised rotated diamond, squares and the recessed lines crossing these which have been described in the text of FIG. 13. One can see clearly that the v-shaped monofilament or multifilament yarns connect the top and bottom surface and that on the top surface a raised structure of knitted lines in the shape of 45 degrees rotated squares have been created in the same knitting process.

FIG. 16 shows a 3-dimensional view of the top of a double knit two plane 3-dimensional structure, with honeycomb shaped raised structures 14 and 15, relative to the production direction of the circular knitting machine, which are again formed by the creation of larger knitting loops in the areas where a raised line has to be created during the knitting process which result finally in the raised rim shaped structures after pulling these longer knitting loops tighter to the rest of the top surface which are the recessed sections The top and bottom plane of this 3-dimensional circular knitted structure are interconnected by the monofilament yarns and or multifilament yarns.

FIG. 17 shows a top view and also knitting pattern of the honeycomb structure on the double knit 3-dimensional structure as raised structure with a horizontal extra gliding line dividing the honeycomb in half. The inner side of the hexagonal, honeycomb structure 16 is the recessed area which is divided in two halves by a horizontal gliding 18 line made of two yarns in one stitch which improves the gliding and friction drastically in the width direction, perpendicular to the wales in the recessed area, which are inherently less smooth as gliding structure. Also visible in FIG. 18 are the gliding lines 17 which are the two parallel sides of the hexagonal raised structure and which give extra low friction and gliding characteristics in the production direction of the fabric. The size of the hexagonal raised structures is not determined to one measure but can be in the range of 2-20 mm or even larger.

FIG. 18 shows a top view and also knitting pattern of the honeycomb structure on the double knit 3-dimensional structure as raised structure with a horizontal extra stepped gliding lines varying from vertical position starting either at the edges of the honeycomb and a halfway dividing position. One can see the pattern of stepped gliding lines 19, 20, 21 in the width direction of the fabric, which are perpendicular to the less smooth wales of the fabric, creating by this a lower friction gliding structure. The raised gliding lines 19, 20, 21, but the raised lines 22 and 23 also consist of either of a series of wales, a series of stitches or of a combination of both. Each stitch or wale consists of a tuck stitch consisting of a longer loop of a tuck stitch knitted together with a knitting stitch, which results in a raised surface above the standard knitted top plane of the 3-dimensional knitted fabric. The size of the hexagonal raised structures is not restricted to one measure but can be in the range of 5-20 mm or even larger.

FIG. 19 shows a top view and also knitting pattern of a small diamond structure on the double knit 3-dimensional structure as raised structure interconnected to each other.

The smaller raised diamond structures have dimensions of 5-10 mm and enhance the gliding characteristics enormously in all directions.

FIG. 20 shows a 3-dimensional drawing of the raised structure of FIG. 18, on the knitted top plane 1, interconnected via the intermediate section with monofilament and or multifilament yarns 12 to a bottom plane 2 in one integral 3-dimensional double knit structure. One can clearly identify on the top plane 1 three raised or stepped horizontal gliding lines 19, 20, 21 lines, which have been created by the same type of long tuck stitches technique such as the raised sides 22 and 23 of the honeycomb structure, consisting of a double knitting stitch and loop, resulting in higher, raised surface of these lines or sides.

FIG. 21 shows a raised structure pattern of interconnected circular elements, which can also be oval of shape and which can be created by the sample of knitting technique as the honeycomb structures of FIG. 4, 11, 17, 18, 20.

FIG. 22 shows a raised structure pattern of interconnected octagonal and square elements, which can be created by the sample of knitting technique as the honeycomb structures of FIG. 4, 11, 17,18, 20, 21.

FIG. 23 shows a 3-dimensional sketch of the possible use of the permanent active stay and transfer layer 2 which stays underneath the patient and covers the spacer fabric and or foam mattress. This active stay and transfer layer is elastic, doesn't enhance pressures, shear forces and limits frictions. Due to the smooth and low friction characteristics as described in the various embodiments above the patient can be pulled and slide over the top surface layer of this active stay and transfer sheet to the side of the bed or other edges for transfers out of bed and repositioning of them. Also visible in the FIG. 23 is the passive stay and transfer sheet 3 which is used to pull at and has a limited elasticity. The passive stay and transfer sheet 3 can be a single knit on both sides smooth fabric and can be connected to the active stay and transfer sheet 2. For transfer it is pulled from the side of the bed and pushed, pulled underneath the patient. Then the caregiver or partner of the patient can pull at the complete combined system to move the patient to one of the sides of the bed. Another embodiment of this passive transfer and stay sheet is a version which can stay underneath the more immobile patients permanently or can be positioned underneath them and which has a limited elasticity, a high water absorption capacity and water blocking layer as described in the embodiments of FIG. 1, 2, 3 or 4.

DETAILED DESCRIPTION OF EMBODIMENTS OF THE INVENTION

A textile article suitable for permanent skin contact, reducing pressures, shear and friction forces and reducing frequent manual transfer handlings is provided by this invention, based upon an elastic stretchable, double knitted, two faced top surface layer, which is either a 3 dimensional double knitted spacer fabric structure with monofilament and or multifilament fibers or a single or double knitted jacquard structure. Various further solutions having possibly additional interconnected underlying layers with other functions are encompassed by the invention. The double knitted jacquard two faced structure and the 3 dimensional double knitted spacer structure can both be produced on a double knit circular so called jacquard knitting machine. The main purposes of this two faced top surface structure are:

- to minimize skin friction and physical stressing of skin and tissue due to friction, shear and pressure forces
- to quickly absorb sweat and urine droplets and transport these from skin to the bottom layer of the two faced structure
- to enable ventilation and venting of the structure
- to collect and save moisture in a special capillary structure in the bottom layer (for the 3-dimensional and jacquard structure).
- To allow easy washing and drying without wrinkles and folds in the surface.

The top surface layer is in most embodiments constructed as a double knitted 3-dimensional structure or double knitted jacquard fabric, consisting of two interconnected layers (surfaces) with raised and recessed areas on the top surface which are preferably both manufactured of one fiber type, bound underneath by an elastic yarn. These raised areas on the top surface of the double knitted two faced elastic structure have horizontal dimensions of at least 1 or more stitches. They are preferably interconnected so as to form continuous lines or planes, and have contact with the skin or clothing of patients. They are normally produced from one type of preferably smooth low friction polymer fibers. These yarns are composed of multifilament PET or PA fibers, bundled together, texturized or non-texturized, having round, trilobal, hexagonal, octagonal, flat, rectangular or square cross sections each, and if necessary elastomeric fibers to enhance elasticity.

- To limit friction forces and to enable easy movement and repositioning of patients, the following characteristics are combined in the knitted fabrics:
- Raised lines and/or areas, which create gliding structures in the production and width direction of the fabric and/or in other possible gliding and repositioning directions in a horizontal plane. Especially the raised lines and/or areas in directions perpendicular or not parallel to the production direction and parallel to the knitting courses and perpendicular to the wales will significantly improve the gliding characteristics of the fabric. These raised lines can be manufactured on the top plane and if necessary also on the bottom plane.
- Use of thin, smooth, non-texturized polymer fibers in the top layer of the two faced knitting structure for the raised and recessed areas and/or lines.
- High water absorption and transport capacity of the fabric, realized via a substantial capillary difference between top and bottom plane.
- Special designs of the raised structures that allow raised structure lines to interrupt any blocking effect of side-lines of the stitch courses in the longitudinal/production direction, such as hexagonal structures with dividing lines, small diamond type of structures, etc.
- Variation in the diameter of the elastomeric fiber used in the top plane compared to the diameter used in the bottom plane to be able to have an easier deformation in case the elastomeric fiber is thinner on the bottom and to group more stitches closely together in case the elastomeric fiber is thicker in the bottom plane. The water absorption capacity in the bottom layer will be highly enhanced by increasing the amount of stitches from 50 to 100%.
- Low rewet of the top layer is also achieved by preventing the capillary properties of the monofil-filaments in the middle section of the 3-D double knitted jacquard fabric.
- A very smooth structure of the bottom layer is also preventing tear and shear forces between the skin of the patient and the top layer due to turning movements of the patient in bed.
- By using thicker non-texturized fibers in the raised structures, the tuck stitches (in German "Fangmaschen") on top of the double knitted jacquard two faced structure and the 3-dimensional double knitted spacer structure various gliding lines and surfaces can be created which will enhance the smoothness and will result in lower friction forces.
- Due to its elastic behaviour towards the underlying mattress and its capacity to follow the body contour of a person, the risk of gliding out of bed is minimum when a person is lying on it.

The shape and dimensions of the raised and recessed areas are not limited to one construction such as hexagonal, octagonal, honeycomb recessed areas with upstanding raised areas surrounding these recessed areas as boundaries or protruding walls, but can also have the shape of a recessed area like a cross, a stairs like structure, a diamond, pane or parallelogram shaped like structure, an hexagonal or octagonal, a circular or oval shape, a random irregular organic shape etc. The raised areas can be rims with a certain dimension consisting of at least 1 row of stitches, and are preferably in most embodiments continuously interconnected to each other for creating continuous gliding lines on the surface for the skin of the person lying on the knitted fabric. The raised lines and areas are manufactured, in most embodiments, of the same type of fiber as the recessed areas, and are parallel to at least the production direction of the circular knitted fabric, and also partly to a width direction of the fabric, enabling herewith in both basic horizontal direction an easy gliding and sliding of the human body. This can be enhanced, as mentioned above, by additional raised gliding lines and areas in other directions that are not parallel or perpendicular to the above mentioned directions. This can be done either via creation of lines extending under angels that are different from the other main lines of the recessed areas, via shifting the basic shapes of the recessed areas, and via combinations of these two methods.

The raised areas can also have the shape of a backside or the inner side of a honeycomb structure, of a cross, of a diamond, of a circle, but raised upwardly, etc. in case of a two faced double knit jacquard structure. Also within these raised and recessed areas additional similar raised or recessed areas with the same shape but smaller dimensions can be knitted, interconnected preferably to the outer raised areas. The height of the raised areas can be variable depending on the specific characteristic of the circular knitting structure and a finishing process.

As mentioned above, preferably non texturized or smooth thin multifilament PET yarns are used to enhance the smoothness of the top layer and if necessary the bottom layer of the transfer sheet. On the top layer the smooth, thin multifilament yarns will enable easy gliding, but also a soft contact and high comfort experience for the user's skin. On the bottom layer a similar type of fibers can be used to create flat or raised and recessed areas to enable easy, low friction gliding of the stay and transfer sheet on an underlying layer, which may be a water vapour permeable singe knit barrier layer or a 3-dimension spacer fabric mini mattress, which is described in another patent application of the inventors.

The specific fibers which can be also used in the top structure besides multifilament texturized and non-texturized PET-yarns are PTFE fibers, UHMPE fibers, PA11 fibers, and PET fibers in the top plane coated with low friction polymer finishes. With multifilament non-texturized PET yarns, UHMPE and PTFE fibers the best smoothness and low friction results can be achieved. In an embodiment, in order to have a very smooth top layer of the circular knitted transfer and stay sheet this top layer is abraded with an appropriate device. Also a velours forming treatment can be applied afterwards.

To create water absorption and transport in the knitted fabric a difference in capillary structure between top and bottom layers has to be generated during the knitting process. The difference in diameter and number of filaments between the top layer yarns and the bottom layer yarns, in both the double knit jacquard structure and the double knit jacquard 3-dimensional structure, results in a capillary functionality which is larger in its fiber dimensions and lower in the quantity or numbers of fiber filaments with the top layer and more refined, smaller in its fiber dimensions and larger in numbers of fiber filaments with the bottom layer of the same knitted structure, allowing water on the top layer to be transported to the bottom layer and if necessary to an interconnected intermediate layer where it will be absorbed. So the amount of capillary water transport canals is lower at the top layer as compared with the bottom layer of the same knitted structure, and/or the horizontal cavity dimensions of the capillaries are larger at the top layer than at the bottom layer of the same knitted structure, resulting in a hydrodynamic capillary transport mechanism for fluids. Additionally the embodiment created by a double knit 3-dimensional two faced structure can have a mixture of monofilament fibers and multifilament fibers in the interconnecting pile section and a similar difference in size and quantity of capillaries between top and bottom layer in order to stimulate water transport.

Construction of the Above Mentioned 3-Dimensional Double Knitted Spacer Fabric:

Gauge 18-50

Weight 380/430 gram-m2. Thickness from 1 mm-4 mm.

a. Top layer:
   PES yarn, non texturised: yarn fineness between decitex 70-150 and filaments 40-120.
   Elastan yarn decitex 22/F1: yarn fineness between decitex 11-78.
b. Middle layer:
   PES Monofil Fiber: Fiber fineness between decitex 22-69.
c. Bottom layer:
   PES yarn, texturised. yarn fineness between decitex 22-150 and filaments 40-120.
   Elastan yarn: yarn fineness between decitex 11-78.

Two-Faced Solution:

Another preferred embodiment is made in connecting a middle layer through a monofil and a multifil yarn joining each other in the same machine feed. A monofil and a multifil yarn are joined together and feed into a machine feed that generates the distance between the top and bottom layers. The monofil yarn PES and the multifil yarn PES are bound in tuck stitches and processed together as two jointed yarns. In this way the water transport in the middle layer is enhanced significantly allowing the top layer to get dry quicker.

Two-Faced-Solution:

Gauge 18-50 double knit; Jacquard

Weight 380/430 gram-m2. Thickness from 1 mm-4 mm.

a. Top layer:
   PES yarn, non texturised: yarn fineness between decitex 70-150 and filaments 40-120.
   Elastan: yarn fineness between decitex 11-78.
b. Middle layer:
   PES Monofil Fiber feeding into 1 slot with Multifil non texturised. Monofil fiber fineness between decitex 22-69, Multifil yarn fineness between decitex 22 69 and filaments 22-80.
c. Bottom layer:
   PES yarn: yarn fineness between decitex 22-150 and filaments 40-120
   Elastan: yarn fineness between decitex 11-78.

3-Dimensional Double Knit Fabric:

Another preferred embodiment is realized on a double knit machine. Two single knit structures are bound together through connecting fibers. The advantage of this 3-D double knit structure is that it can be produced at a far lower weight and through this lower costs. Here also a choice can be made for the so called two joined solution in the middle layer of the 3-D double knit structure.

3-D Double Knit Structure: Gauge 18-E 50.—

Weight 240/330 gram/m2. Thickness 2.5 mm-5 mm.

a. Top layer:—
   PES yarn, non texturised: yarn fineness between decitex 70-150 and filaments 40-120.
   Elastan Fiber decitex 22/F1: Fiber fineness between decitex 11-78.
b. Middle layer:
   PES monofil yarn. Feeding into 1 feed together with multifil non texturized yarn.
   Monofil yarn fineness between decitex 22-69. Multifil yarn fineness between decitex 22-69 and filaments 22-80.
c. Bottom layer:
   PES yarn, texturised: yarn fineness between decitex 22-150 and filaments 40-120
   Elastan yarn: yarn fineness between decitex 11-78.

Additionally, the top layer or fibers used at the top layer can be treated with a finish, plasma or corona treatment and/or coating to enhance the hydrophilic characteristics resulting in faster water uptake and absorption. The combination of the raised and recessed areas of knitted yarns with different cross sections and number of filaments in a stay and transfer layer serving as a permanent bed sheet is an innovative characteristic of the innovation enabling low friction characteristics, an easy water and moisture uptake and downwards directed transport, and wrinkle free washing and use of the stay and transfer sheet.

The upper yarns creating the raised structure are in one embodiment connected directly via the double knitted structure to a bottom surface or layer in which another type of these polymer yarns is used as second basic knitting yarn.

In another embodiment the yarns of the top layer, which has raised and recessed areas manufactured from one type of fiber are connected to the bottom layer via interconnecting monofilament pile fibers and or multifilament yarns, creating a 3-dimensional circular knitted double faced structure. In this 3-dimensional embodiment the use of elastomeric yarns in the top and bottom layers enhances the stretching ability and elasticity enormously, but also pulls the stitches together enough to create a smooth surface.

The diameter and strength of the elastomeric yarn in the top layer can be higher than the diameter and strength of the elastomeric yarn in the bottom layer, resulting in a larger deformation capacity at the bottom layer to follow the body contour more precisely and to distribute the weight of the person lying upon it more evenly. This effect can also be achieved by a variation of elastomeric yarn in the top layer versus the bottom layer, thus having a higher elastomeric yarn content in the top layer than in the bottom layer.

The diameter and strength of the elastomeric yarn in the top layer can in another specific embodiment also be (50%) lower than the diameter and strength of the elastomeric yarn in the bottom layer, resulting in a largely enhanced capacity to store perspiration or larger void at the bottom layer due to the effect of the thicker elastic yarn to group 50 to 100% more stitches per $cm^2$. Additionally the non-texturized PET yarn in the bottom can be replaced by a texturized yarn thereby enhancing the hydro-retention in the bottom plane. This will allow the, bottom layer to store vast quantities of liquid. This variation in elastomeric fiber amount will also result in a flat character and shape of the knitted fabric after production.

The recessed areas of the double knitted structure in the version without monofilament fibers are basically knitted from the yarns which are being used for the bottom structure. They do not have contact with the skin, allowing ventilation, water absorption and uptake, and having a low friction functionality in case of the embodiment of the double knit jacquard construction.

In the embodiment of the 3-dimensional circular knitted two faced structure, with monofilament and or multifilament yarns interconnecting the top and bottom surface, the recessed area is actually the larger part of the top surface plane on which an additional raised structure is knitted in the same process creating the initial contact surfaces for the body of the patient. This is done by creating a specific longer tuck stitch consisting of one yarn which is a tuck stitch of the same polymer yarn in the top surface, which produces one larger loop bound together by a knitting stitch giving the raised structure. These tuck stitches with raised structure look a bit like embroidery, but are created directly during the same circular knitting process, resulting in a raised structure which limits friction and enables easy movement in bed, or transfers in and out of bed, which can be even be enhanced when the used multifilament is thicker and is preferably a non-texturized yarn.

The raised and recessed areas in the knitting structure are preferably constructed with a double knit circular jacquard machine, machine gauge 18 to 50, more preferable 24 to 42. This specific knitting structure can also be produced with a circular double knit "8 lock" interlock machine generating loops of yarns at the top surface (so called frotté), which can be treated afterwards as velours and can also be produced with a double knit circular knitting jacquard machine which is able to produce spacer fabric structures to create the 3-dimensional version with intermediate pile fibers as described above.

Another embodiment of the invention to be produced by a double knit "8-lock" circular knitting machine is an intermediate water absorbing layer and is a flat double knitted interconnected 2 layer structure, in which the top layer is consisting of cotton yarns and the bottom layer of very smooth polymer yarns. The double faced structure has a material composition consisting of 10-30% cotton fibers and 70-90% PET fibers. This structure can be used as a fluid or vapour absorbing layer underneath the two-faced double knitted 3-dimensional jacquard structure, when it's bonded with glue points to a smooth single backing layer with a barrier function (via means of a hydrophobic finish or venting membrane) to prevent leakage of fluids to a lower level. This combination of two knitted structures enables transfer, allows sliding of the two structures on top of the 3-dimensional warp knitted structure. A possible use of this embodiment is its use as a top layer and as a skin contact layer for patients suffering from incontinence.

Another embodiment of the invention which can be manufactured by a double knit "8 lock" circular knitting machine is a top or intermediate water absorbing layer and is a flat double knitted interconnected 2 layer fabric structure, in which the top layer is consisting of very smooth yarns with high decitex and low amount of filaments and at the bottom layer a texturized polymer yarn of low decitex with high amount of filaments. This structure can be also used as a fluid or vapour intermediate absorbing layer in combination with a smooth single bonded backing layer with barrier function (via means of a hydrophobic finish or venting membrane), allows sliding of the two structures on top of the 3-dimensional warp knitted structure) in the use as intermediate layer, or allows sliding of a patient when it is used as top layer. The embodiment can thus possibly be used as a top or intermediate layer as mentioned above in the paragraph with the already mentioned two faced embodiments.

Interlock Barrier Layer: Gauge 18-50. Pique Structure.

a. PES yarn, non texturised. Width of 185 cm.

yarn fineness between decitex 50-150 and filaments 40-120.

or b. PES yarn, non texturised. Width of 165 cm yarn fineness between decitex 70-150 and 40-120 filaments.

Elastomeric yarn, yarn fineness between decitex 11-78.

In an another embodiment the top structure can consist of a single knit top layer with raised and recessed areas that can be dot coated to a second layer consisting of a double knit structure that can take up water very well, such like a composition of cotton and polyester.

Single Knit Raised Structure: Gauge 18-50

Raised and recessed areas:

PES yarn, non texturized, yarn fineness between decitex 50-150 and filaments 40-120.

The double faced structure has a material composition consisting of 10-30% cotton fibers and 70-90% PET fibers Interlock Double Knitted Fabric: Gauge 18-50

Top layer and bottom layer are knitted together

Top layer: ±30% of the fabric weight.—Cotton. yarn fineness between NM 50-NM 170.

Bottom layer: ±70% of the fabric weight.

PES, non texturized, yarn fineness decitex 33-150. Filaments 16-150,

Another embodiment of the barrier layer is made from just an open single knit PET structure, which is very smooth and which is foulard coated with a PUR or dendrimer based finish or a venting membrane.

Summary of the Most Preferred Embodiments of the Permanent Stay and Transfer Sheet and Special Versions Thereof are:

1. A double faced knitted fabric with raised and recessed structures on the top plane made from one type of polymer fiber, either a 3-dimensional knitted jacquard fabric with monofilament yarns and possibly multifilament yarns interconnecting top and bottom layers, or a jacquard single or double knitted fabric without those monofilament or multifilament yarns.

2. A double faced knitted fabric with raised and recessed structures on the top plane made from one type of polymer yarn, and on the bottom plane made from the same or a different type of polymer yarn, either being a 3-dimensional knitted jacquard fabric with filament yarns and possibly multifilament yarns interconnecting top and bottom layers, or a jacquard single or double knitted fabric without those monofilament or multifilament yarns.

3. A double faced knitted fabric with raised and recessed structures on the top plane made from one type of polymer yarn, either a 3-dimensional knitted jacquard fabric with monofilament yarns and possibly multifilament yarns interconnecting top and bottom layers, or a jacquard single or double knitted fabric without those, in which the top layer has a larger yarn diameter and less filaments per yarn than the bottom layer which is manufactured of a layer with an equal or smaller diameter and or larger number of filaments. A preferred embodiment has in the top plane raised areas or lines which are interconnected to each other in a continuous fashion and which form gliding lines in at least two directions to limit friction with the skin of a patient. The bottom plane is consisting of a very smooth structure preventing tear and shear forces between the skin of the patient and the top plane due to turning movements of the patient in bed.

4. The single and double knitted fabrics have raised areas or lines which are interconnected to each other in a continuous fashion and which form gliding lines in at least two directions to limit friction with the skin of a patient.

5. The preferred embodiments have raised gliding lines in the machine width direction and perpendicular to the stitch wales of the fabric which compensate for the intrinsic diminished gliding characteristics over these stitch wales, which can also be in other directions under smaller or larger angles with the horizontal axis of the fabric.

6. The preferred embodiments have raised gliding lines in the machine width direction and perpendicular to the stitch wales of the fabric, which compensate for the intrinsic diminished gliding characteristics over these stitch wales, which can be created with the above mentioned gliding lines or areas. Above mentioned gliding characteristics are also obtained by the orientation and positioning of the basic shapes of the raised structures (diamond shape, octagonal, hexagonal, round, oval etc.) and combinations of both.

7. All preferred embodiments as described above may get a venting and a vapour and gas permeable liquid barrier underneath consisting of a polymer finish applied via a foam or spray process, such as hydrophobic coating, PUR-finishes, fluorocarbon finishes, dendrimer based finished etc.

8. All preferred embodiments as described above may get a venting and vapour and gas permeable but liquid tight membrane underneath consisting of PET, PUR, nanofibers, PTFE or other type of membrane material.

9. All preferred embodiments as described above may get a single knit backing layer under a venting and vapour and gas permeable liquid barrier to ensure easy gliding between bottom layer and underlying structures and to protect finishes and coatings 10. The double knitted two faced fabric can be replaced by a single knit fabric with similar raised and recessed lines and areas, which can, as described under 6 and 7, also be made liquid tight. This single knit layer could be used as direct skin contact layer or as protective layer underneath the permanent stay and transfer double knit fabric as described under embodiments 1, 2, 3, 4, 5, 6.

In the texts below we describe again various possible embodiments of the stay and transfer sheet.

The Different Embodiments of the Stay and Transfer Sheet:

In order to ensure controlled water absorption, proper micro-climate and patient transfer properties of the stay and transfer sheet the following compositions or preferred global embodiments have been considered. The essence of these embodiments is that in all cases the top layer is a double knit elastic layer with raised and recessed areas, either a jacquard knitted two plane layer or a double knit two plane 3-dimensional structure and this layer can be glued via dot coating technique to another membrane type of layer or can itself be treated in such a way that leakage to the underlying mattress is prevented by applying a sprayed or foamed PUR coating to the bottom plane of the double knit fabric and or non-sliding, gluing side of the single knit layer.

Stay and Transfer/Bedsheets Constructions:

a. Passive stay and transfer sheet.

An inelastic transfer sheet is needed in order to transfer an immobile patient together with the sheet. The inelasticity is to assure efficient transport by nursing staff.

The top surface being a double knitted textile fabric is dot coated with elastic Hotmelt glue to a PU membrane film blocking water but which is breathable and is allowing vapours and gases to go through. This composition of 2 layers is then dot glue coated (with PU) to a low friction bottom surface, preferably a smooth, low friction single knit fabric of PET-fibers that is guaranteeing low friction transfer, sliding and limits the shear forces drastically. The PU membrane is normally composed of a micro porous film and in this embodiment foreseen with a monolithic membrane that ensures continuous breathability and has limited elasticity. The amount of glue used will limit the overall elasticity in the both horizontal directions of the 3-layer passive transfer and stay sheet and will allow direct pulling and sliding of this sheet on the underlying materials when the patient is on it.

A special embodiment of this passive stay and transfer sheet can be a version which has due to its double knitted structure and number of filaments of fibers, extra moisture absorption capacity for persons who sweat more than moderate or suffer from urine overflow from their incontinence diapers and can be a velours structure with raised and recessed areas or a double knitted two plane structure made of a combination of the last one with a velours layer as described or a two layer double knit jacquard or 3-dimensionals structure with raised and recessed areas on top.

The 1 layer passive stay and transfer double knitted textile fabric is produced on an interlock "8 lock" machine with a gauge from 28 to 48, more preferable between 36 and 44. The structure is composed of a 100% PET yarn with a fineness of between 50 and 150 decitex and between 40 and 120 filaments. The interlock knitted structure is modified in such a way that it is limiting the elasticity of the fabric in the width and longitudinal direction to such a limit that the final elasticity is between 3 and max 8%.

b. Active stay and transfer sheet:

An elastic transfer sheet is needed in order to enable a mobile patient to transfer himself on that sheet and/or with assistance of the nursing staff. The top surface being a double knitted textile fabric with two planes that is dot glue coated to a PU membrane blocking water but who is breathable and is letting vapours and gases go through. This PU membrane is dot coated to a low friction bottom surface/backing that is ensuring the protection of the monolithic or polymer membrane and which is preferably an elastic single knit fabric of PET-fibers.

c. Passive transfer stay sheet/3 or 4 layers.

The top surface being a double knitted textile fabric is dot glue coated to a low friction bottom single knit surface to guarantee low shear forces of the stay and transfer sheet on the underlying materials. This low friction bottom surface is treated with a breathable water repellent finish such as PUR finish, a FluorCarbon C6 finish, a dendrimer based finish or a silicone polymer finish and or a membrane, of which the PUR spray or foam finish can be applied on the bottom side of the two plane fabric and on the top side of the single knit fabric enabling a higher barrier function for water vapour.

d. Active transfer stay sheet/3 or 4 Layers. See description under c.

The top surface being a double knitted textile fabric that is dot glue coated to an elastic single/double knit backing. This surface or surfaces can be provided with a breathable water repellent finish and or membrane such as described in embodiment.

e. Special embodiment with a 3D spacer fabric two plane structure.

In one embodiment the permanent active and or passive stay and transfer sheet will consist of a special 3-dimensional double knitted spacer fabric in which top and bottom layers are interconnected through monofilament and or multifilament fibers. The top and bottom layer are very soft and have low friction properties and have different fiber composition with a lower number of filaments on top than at the bottom and an equal or higher single filament diameter at the top surface.

On the top surface a raised structure is created in the (circular) knitting process by the creation of tuck stitches, which are 2-3 times longer than the regular knitting loops of the multifilament fiber and which are pulled tighter creating a raised rim or line. The bottom layer of this embodiment but also of embodiments a, b, c, d can be produced with the laminating/coating of a monolithic membrane or special membranes/finishes as described below. The top layer has a mini raised grid structure with raised and recessed areas to reduce skin frictions. Between the top- and under layer small also square, rectangular or diamond shaped sections of monofils can be produced that are surrounded on all sides with open areas without monofils, which result in better tri axial elastic, elongation and independent resilience properties. These sections can adapt their individual pressure reducing capacity to the changing forms/contours of the human body and the different cold- and memory foam mattress. The bottom layer has a structure of smooth non texturized fibers so that it can distribute pressure forces to the under laying mattress structures.

f. Another embodiment of the invention is in x and y directions elastic cover sheet with a smooth top layer and breathable membrane layer beneath it, serving as cover for the Mini mattress and allowing the stay and transfer sheet to reduce the shear and friction forces that occur when the patient is laying on it. The top layer of the coversheet is produced on a single knit machine with a gauge between 22 till 44 more preferable between 26 till 36 This single knit is based on a pique structure is made from PET yarns and specific percentage of elastomeric yarns and is dot coated to a breathable PU membrane between 10 and 40 micron meter thick. The composition assures protection of the mini mattress and allowing ventilation of vapours and through its elasticity enhances the pressure reduction process.

g. Another embodiment of the barrier layer is made from an open single knit PET structure, which is very smooth and foreseen with a PU finish or dendrimer based finish or coating, which can fulfil a function as a barrier and gliding layer h. Single plane circular knitted passive stay and transfer layer, consisting of a double knit circular knitted fabric with limited elasticity via the so called interlock system and with raised lines or surfaces on top and or bottom surface. Both sides of the product are knitted with a very smooth PET yarn.

Composition of Membranes and Finishes:

As described on previous pages we consider the necessity of using a water blocking layer in the construction, which is nevertheless permeable to gases and vapours. For this we can use the following solutions, which are not limited to these solely.

1. Elastic Polyurethane membrane (monolithic, porous)
2. Non elastic Polyurethane membrane (monolithic, porous)
3. PTFE Membrane, also inelastic versions
4. Nanofiber membranes. Through electro spinning of nano fibres a nonwoven layer of 50-100 micron is produced allowing breathability and blocking liquid passage.
5. Silicon polymer based finish
6. Polyurethane coating, e.g. Purtex. Via spray or foam or foulard systems a PUR coating can be applied upon the textile surface layer. This coating guarantees breathability and blocks water.
7. PUR direct coating on the textile layer in wet condition via spray, foam or foulard treatment.
8. Foulard, spray or foam applied finishes with dendrimer or other nanomaterial based solutions to prevent water drops from entering the fabric.

A smart textile solution to facilitate permanent and long time staying in wheelchairs, chairs and on beds of chronically ill, less mobile and immobile patients especially in the elderly care, nursery care, rehabilitation and homecare in the embodiment of a textile based stretchable stay and transfer layer which can cover mattresses and cushions. Technical solutions within the invention are provided to guarantee a dry skin and to control the temperature thereof, the so called control of the micro climate, to lower and evenly distribute pressures and shear forces, and moreover to enable an easy low friction movement of patients in bed or in sitting positions, and to enable transfers into the bed and transfers out of the bed.

The invention claimed is:

1. A stretchable stay and transfer sheet comprising a knit fabric having a user contacted outer surface, wherein the outer surface comprises raised and recessed areas with respect to a plane defined by the outer surface, wherein the raised and recessed areas are formed by stitches and are arranged in a predetermined pattern adapted to lower and distribute friction forces with a user contacting the outer surface, said pattern comprising raised areas having a horizontal dimension of one stitch or more in a direction of its stitch courses and of its stitch wales, raised areas of the pattern form gliding lines for the user contacting the outer surface, the gliding lines extending over a length and/or width dimension of the knit fabric;

wherein at least some of the recessed areas have a shape selected from the group of square, rectangular, hexagonal, octogonal, polygonal, honeycomb, circular, oval, diamond, cross, and irregular and are surrounded by gliding lines forming rims of the at least some of the recessed areas.

2. The stretchable sheet of claim 1, wherein the knit fabric comprises a double knit fabric having a top layer and a bottom layer connected thereto by yarn extending between the top layer and the bottom layer, and wherein the top layer comprises the user contacted outer surface and at least the top layer includes elastic yarn.

3. The stretchable sheet of claim 1, wherein the gliding lines are continuous at least over the length of the fabric.

4. The stretchable sheet of claim 1, wherein the pattern comprises gliding lines oriented in a direction of the stitch wales of the fabric.

5. The stretchable sheet of claim 1, wherein the pattern comprises gliding lines oriented in a direction of the stitch courses of the fabric.

6. The stretchable sheet of claim 1, wherein the pattern comprises gliding lines oriented obliquely to the stitch courses and the stitch wales.

7. The stretchable sheet of claim 1, wherein the raised areas comprise stitches having upstanding longer loops of yarn than stitches forming adjacent recessed areas.

8. The stretchable sheet of claim 1, wherein the raised areas comprise tuck stitches.

9. The stretchable sheet of claim 2, wherein the top layer comprises a top layer multifilament yarn and the bottom layer comprises a bottom layer multifilament yarn, wherein filaments of the top layer multifilament yarn knitted in the top layer have a diameter being equal to or greater than a diameter of filaments of the bottom layer multifilament yarn knitted in the bottom layer.

10. The stretchable sheet of claim 1, wherein the top layer comprises a top layer multifilament yarn and the bottom layer comprises a bottom layer multifilament yarn, the top layer multifilament yarn has a number of filaments being equal to or lower than a number of filaments of the bottom layer multifilament yarn knitted in the bottom layer.

11. The stretchable sheet of claim 2, wherein the top layer comprises a top layer elastic yarn and the bottom layer comprises a bottom layer elastic yarn, wherein the top layer elastic yarn has a diameter and resilience higher than a diameter and resilience of the bottom layer elastic yarn knitted in the bottom layer.

12. The stretchable sheet of claim 2, wherein the top layer comprises a top layer elastic yarn and the bottom layer comprises a bottom layer elastic yarn, wherein the top layer elastic yarn has a diameter and resilience lower than a diameter and resilience of the bottom layer elastic yarn knitted in the bottom layer.

13. The stretchable sheet of claim 12, wherein in an unstretched condition a number of stitches per $cm^2$ is between 50% and 100% greater in the bottom layer than in the top layer.

14. The stretchable sheet of claim 2, wherein yarns knitted in the top layer are selected from the group of: PES, PET, PTFE, UHMPE, PA.

15. The stretchable sheet of claim 14, wherein the top layer comprises only non-texturized yarn and the bottom layer comprises texturized yarn.

16. The stretchable sheet of claim 14, wherein at least one of the yarns is coated with a low friction polymer finish.

17. The stretchable sheet of claim 2, wherein the bottom layer has a smooth outer surface.

18. The stretchable sheet of claim 2, wherein the bottom layer comprises raised and recessed areas on its outer surface.

19. The stretchable sheet of claim 2, further comprising one or both of a water barrier layer or a gas and vapor permeable layer arranged on an outer surface of the bottom layer.

20. The stretchable sheet of claim 19, further comprising a membrane acting as one or both of the water barrier layer or the gas and vapor permeable layer.

21. The stretchable sheet of claim 2, further comprising one or both of a polyurethane layer or a dendrimere finish layer applied or attached to an outer surface of the bottom layer.

22. The stretchable sheet of claim 21, wherein one or both of the polyurethane layer or the dendrimere finish layer are covered by a single knit elastic fabric layer that is attached thereto.

23. The stretchable sheet of claim 2, wherein the double knit fabric is a 3-dimensional spacer fabric having monofilament or multifilament spacer yarns between the top layer and the bottom layer.

24. The stretchable sheet of claim 2, wherein the double knit fabric is a Jacquard fabric.

25. The stretchable sheet of claim 1 wherein the knit fabric includes elastic yarn.

* * * * *